US005855207A

United States Patent [19]

Moenning et al.

[11] Patent Number: 5,855,207

[45] Date of Patent: Jan. 5, 1999

[54] MEDICAL TABLE ASSEMBLY HAVING A RESTRAINMENT APPARATUS MOUNTED THERETO AND AN ASSOCIATED METHOD OF IMMOBILIZING OBJECT

[76] Inventors: Stephen P. Moenning, 124 Hibiscus, Punta Gorda, Fla. 33950; Charles Manker, 35. N. Greenbay Rd., Lake Forest, Ill. 60045

[21] Appl. No.: 865,084

[22] Filed: May 29, 1997

[51] Int. Cl.[6] ..... A61G 15/00

[52] U.S. Cl. ..... 128/845; 128/869; 5/81.1 C; 5/81.1 R; 5/689; 5/702

[58] Field of Search ..... 128/845, 846, 128/869, 870; 5/81.1 R, 81.1 C, 88.1, 689, 702, 709, 911–913, 660, 710, 713

[56] References Cited

U.S. PATENT DOCUMENTS

| | | | |
|---|---|---|---|
| Re. 34,753 | 10/1994 | Groiso . | |
| 349,696 | 9/1886 | Davis . | |
| 1,529,546 | 3/1925 | McKenzie . | |
| 3,212,497 | 10/1965 | Dickinson . | |
| 3,397,688 | 8/1968 | Gottfried . | |
| 3,545,237 | 12/1970 | Thompson et al. . | |
| 3,745,998 | 7/1973 | Rose . | |
| 3,762,404 | 10/1973 | Sakita . | |
| 4,308,862 | 1/1982 | Kalmar . | |
| 4,347,213 | 8/1982 | Rogers | 264/510 |
| 4,628,911 | 12/1986 | Bornstein . | |
| 4,657,003 | 4/1987 | Wirtz . | |
| 4,885,811 | 12/1989 | Hayes . | |
| 4,996,979 | 3/1991 | Grim et al. . | |
| 5,311,882 | 5/1994 | Gagne . | |
| 5,407,421 | 4/1995 | Goldsmith . | |
| 5,427,577 | 6/1995 | Picchietti et al. . | |
| 5,556,169 | 9/1996 | Parrish | 292/452.28 |
| 5,558,627 | 9/1996 | Singer et al. . | |
| 5,569,172 | 10/1996 | Padden et al. . | |
| 5,588,956 | 12/1996 | Billotti . | |
| 5,626,150 | 5/1997 | Johnson | 128/870 |

*Primary Examiner*—Michael A. Brown
*Attorney, Agent, or Firm*—Maginot, Addison & Moore

[57] ABSTRACT

A medical table assembly includes a bed frame and a mattress supported by the bed frame. The medical table assembly also includes a restrainment apparatus mounted to the bed frame, wherein the restrainment apparatus includes (1) a strap which (a) defines a fluid impervious bag having a void therein, and (b) is attached to the bed frame so that the fluid impervious bag is positioned over the mattress, and (2) a plurality of beads contained within the void of the fluid impervious bag. The medical table assembly further includes a vacuum source in fluid communication with the void of the restrainment apparatus. An associated method of immobilizing an object is also disclosed. The method includes the use of actuators which cause interior side panels of a passageway defined through a restrainment apparatus to automatically "clamp down" on an object positioned within the passageway upon evacuation of a void defined within the restrainment apparatus.

28 Claims, 25 Drawing Sheets

MEDICAL TABLE ASSEMBLY HAVING A RESTRAINMENT APPARATUS MOUNTED THERETO AND AN ASSOCIATED METHOD OF IMMOBILIZING OBJECT

CROSS REFERENCE

Cross reference is made to copending U.S. patent application Ser. No. 08/815,622 (Attorney Docket No. 1874), entitled "Medical Table and Method for Moving a Patient From a First Position to a Second Position" by Stephen P. Moenning, Douglas B. Thatcher, and Donald M. Judy.

BACKGROUND OF THE INVENTION

The present invention generally relates to a medical table assembly, and more particularly relates to a medical table assembly having a restrainment apparatus mounted thereto.

Many medical procedures are performed with a patient lying on a medical table. Typically, the medical table on which the patient is lying is made from a very hard and uncomfortable material. Moreover, many medical procedures require the patient to be minimally clothed and may take a significant amount of time to complete. Therefore, the patient lying on the table can become very uncomfortable (e.g. cold, or hot if the patient is suffering from a fever), which increases the stress he or she experiences during the medical procedure.

Additionally, it often becomes necessary to adjust the patient's position on the medical table from a first position to a second position in order to successfully complete the medical procedure. For example, patients undergoing a colonoscopic medical procedure are frequently moved from a supine position (i.e. denoting a body when lying face upward) to a lateral position (i.e. denoting a body when lying on its side) to facilitate the advancement of an endoscope to a patient's colon. Furthermore, other medical procedures, such as radiographic imaging studies, may require a patient to be moved from a supine position to a prone position (i.e. denoting a body when lying face downward).

The movement of a patient lying on a medical table from a first position to a second position has heretofore largely depended upon a great deal of physical effort being exerted by attending medical personnel. For example, to move a patient positioned in a supine position to a prone position typically requires attending medical personnel to pull or tug a bed sheet on which the patient is lying so as to gradually move the patient toward an edge of the medical table. As the patient is moved toward the edge of the medical table, other medical personnel lift and push the patient's shoulder which is closest to the edge, in a direction opposite to the direction the bed sheet is being pulled. The simultaneous pulling of the bed sheet in one direction, while the patient's shoulder is lifted and pushed in the opposite direction, rolls the patient over from a supine position to a prone position.

One disadvantage of repositioning the patient in the above described manner is that the involved medical personnel are prone to injuries resulting from the pulling or tugging of the bed sheet. For example, they sometimes suffer from sprained wrists or backs that occasionally result in incurring some degree of disability. This is especially true when the patient is a large adult. Another disadvantage is that the pulling or tugging of the bed sheet causes the patient to be moved in a "jerking motion." This jerking motion can be extremely uncomfortable, or even dangerous to the patient depending upon the type of illness of the patient (e.g. osteoporosis or arthritis).

Under certain circumstances, the patient must be restrained on the medical table after adjustment to an appropriate position. Various types of restrainment apparatus are used to secure the patient to the medical table. Heretofore, these restrainment apparatus typically include one or more straps attached to the medical table and a buckle attached to each strap. Each strap is positioned relative to the patient such that one end thereof encircles one of the patient's limbs (e.g. an arm or a leg). The buckle and strap are then manipulated so that the strap fits snugly around the patient's limb, thereby restraining the patient to the medical table. To release the patient from the medical table the attending medical personnel must manipulate each buckle and strap again to loosen the strap from around the patient's limb.

One disadvantage of the above described restrainment apparatus is that the required manipulation of the buckle and strap to tighten and loosen the strap from around the patient's limb is inconvenient and time consuming for attending medical personnel. This inconvenience can be dangerous for the patient in situations where he or she must be quickly released from the medical table prior to the administration of emergency medical care. This inconvenience can also be dangerous for the medical personnel and the patient in situations (e.g. a violent patient) where the patient must be quickly restrained on the medical table.

It would therefore be desirable to provide a medical table assembly having a restrainment apparatus that allows a patient to be secured thereto in a quick and efficient manner. It would also be desirable to provide a medical table assembly having a restrainment apparatus that allows a patient to be released therefrom in a quick and efficient manner. It would further be desirable to provide a medical table assembly having a restrainment apparatus that easily adjusts and conforms to different size limbs.

SUMMARY OF THE INVENTION

In accordance with one embodiment of the present invention, there is provided a medical table assembly. The medical table assembly includes a bed frame. The medical table assembly also includes a restrainment apparatus mounted to the bed frame, wherein the restrainment apparatus (1) defines a fluid impervious bag having a void therein, and (2) contains a plurality of beads within the void of the fluid impervious bag. The medical table assembly further includes a vacuum source in fluid communication with the void of the restrainment apparatus.

In accordance with another embodiment of the present invention, there is provided a medical table assembly. The medical table assembly includes a bed frame and a mattress supported by the bed frame. The medical table assembly also includes a restrainment apparatus mounted to the bed frame, wherein the restrainment apparatus includes (1) a strap which (a) defines a fluid impervious bag having a void therein, and (b) is attached to the bed frame so that the fluid impervious bag is positioned over the mattress, and (2) a plurality of beads contained within the void of the fluid impervious bag. The medical table assembly further includes a vacuum source in fluid communication with the void of the restrainment apparatus.

In accordance with still another embodiment of the present invention, there is provided a medical table assembly. The medical table assembly includes a bed frame and a mattress supported by the bed frame. The medical table assembly also includes a first restrainment apparatus mounted to the bed frame, wherein the first restrainment apparatus (1) defines a fluid impervious bag having a void therein, (2) contains a plurality of beads within the void of the fluid impervious bag, and (3) has a passageway extending therethrough for receiving a first body part of a patient positioned on the mattress. The medical table assembly further includes a vacuum source in fluid communication with the void of the first restrainment apparatus.

According to yet another embodiment of the present invention, there is provided a securement assembly. The securement assembly includes an anchoring member. The securement assembly also includes a restrainment apparatus attached to the anchoring member, wherein the restrainment apparatus (1) defines a fluid impervious bag having a void therein, and (2) contains a plurality of beads within the void of the fluid impervious bag. The securement assembly also includes a vacuum source in fluid communication with the void of the restrainment apparatus.

According to still another embodiment of the present invention, there is provided a method of immobilizing an object. The method includes the steps of (a) providing a restrainment apparatus, wherein the restrainment apparatus (1) includes a fluid impervious bag having a void therein, (2) contains a plurality of beads within the void of the fluid impervious bag, (3) has a first interior side panel which defines a first portion of a passageway defined in the restrainment apparatus, and (4) includes an actuator coupled to the first interior side panel, (b) positioning the object within the passageway, (c) providing a vacuum source in fluid communication with the void, and (d) creating a vacuum within the void with the vacuum source such that the actuator causes the first interior side panel to move toward the object.

It is therefore an object of the present invention to provide a new and useful medical table assembly.

It is another object of the present invention to provide an improved medical table assembly.

It is yet another object of the present invention to provide a new and useful securment assembly.

It is still another object of the present invention to provide an improved securment assembly.

It is another object of the present invention to provide a medical table assembly having a restrainment apparatus that allows a patient to be secured thereto in a quick and efficient manner.

It is still another object of the present invention to provide a medical table assembly having a restrainment apparatus that allows a patient to be freed therefrom in a quick and efficient manner.

It is yet another object of the present invention to provide a medical table assembly having a restrainment apparatus that easily adjusts and conforms to different size limbs.

DETAILED DESCRIPTION OF THE PREFERRED EMBODIMENT

Figure 1:
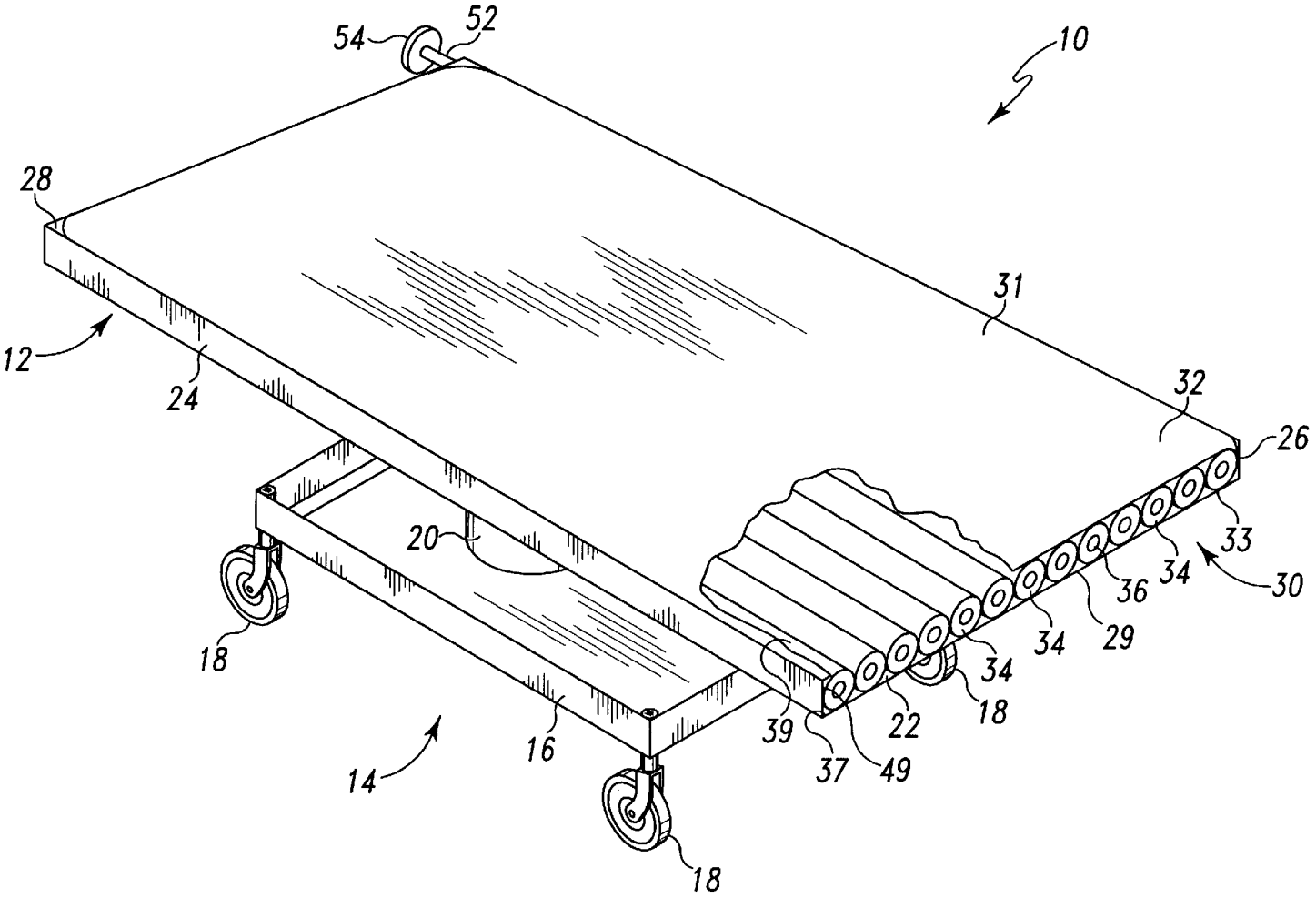
FIG. 1 is a perspective view of a medical table that incorporates the features of the present invention therein, with an end wall and a portion of the belt of the medical table removed for clarity of description.

While the invention is susceptible to various modifications and alternative forms, a specific embodiment thereof has been shown by way of example in the drawings and will herein be described in detail. It should be understood, however, that there is no intent to limit the invention to the particular form disclosed, but on the contrary, the intention is to cover all modifications, equivalents, and alternatives falling within the spirit and scope of the invention as defined by the appended claims.

Figure 2:
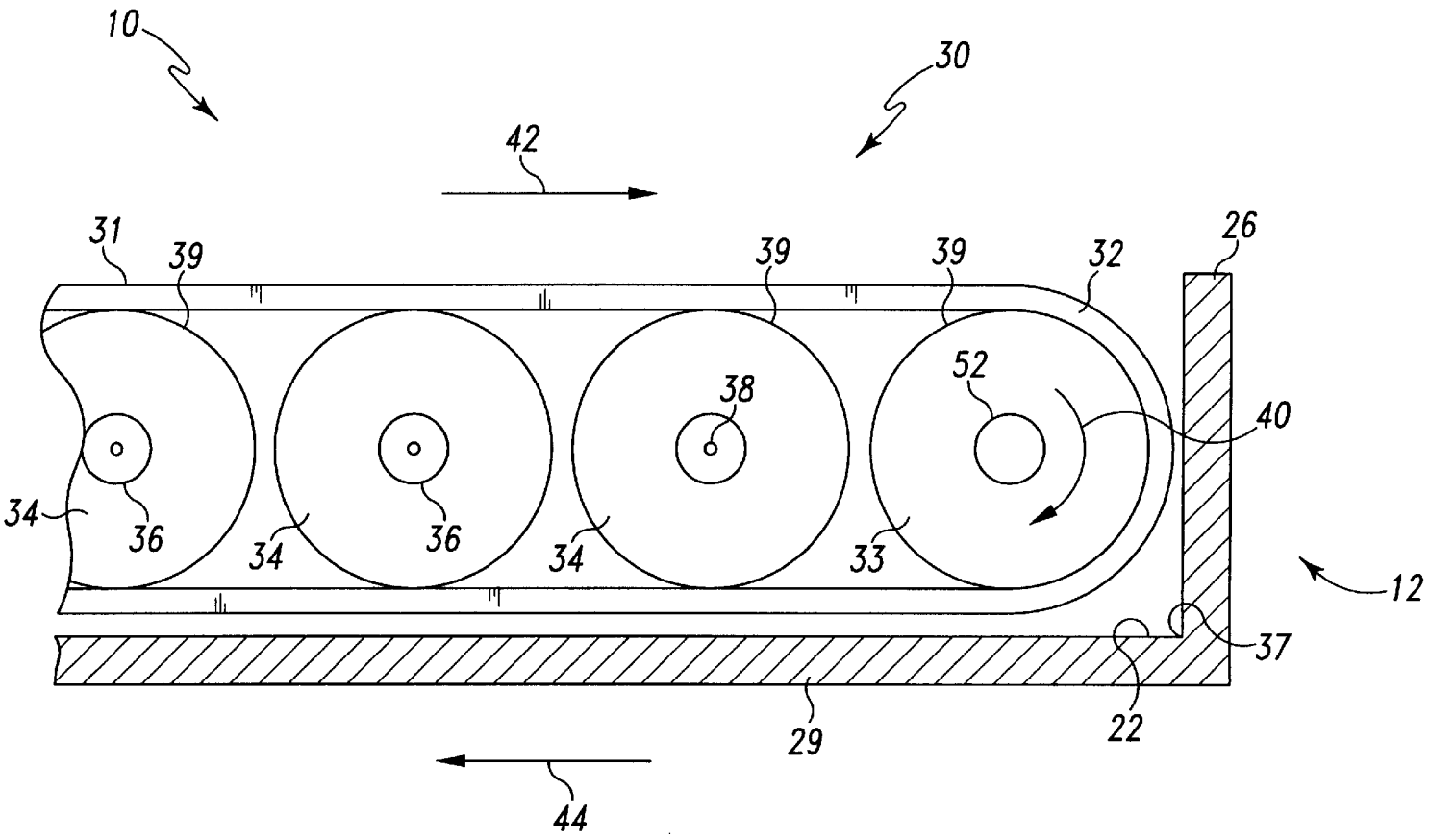
FIG. 2 is an enlarged fragmentary elevational view of an end of the medical table of FIG. 1, with the one-way valves of the secondary rollers removed for clarity of description.
Figure 3:
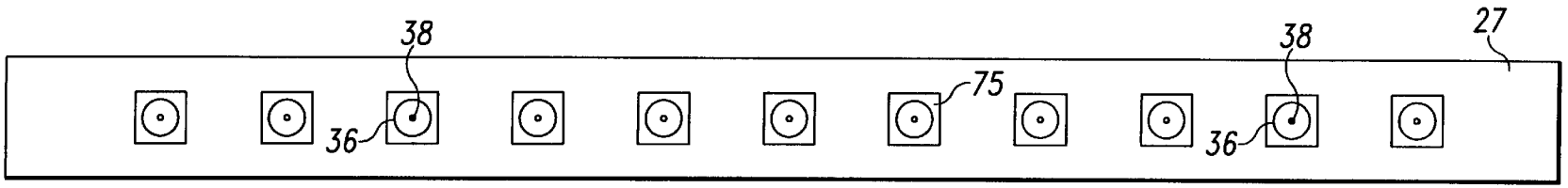
FIG. 3 is an elevational view of the end wall of the medical table of FIG. 1, showing a number of ball-bearing brackets mounted therein.

Referring to FIGS. 1, 2 and 3, there is shown a medical table 10 which safely and comfortably moves or facilitates moving a patient lying thereon from a first position to a second position. For example, operation of medical table 10 moves a patient from a supine position (i.e. denoting a body when lying face upward) to a prone position (i.e. denoting a body when lying face downward) as will be discussed below.

Medical table 10 includes a bed shell 12 having a roller-belt complex 30 mounted in bed shell 12. Medical table 10 also includes a support member 20 attached to and supporting bed shell 12, while only one support member 20 is shown, one or more support members may be added for additional stability. Support member 20 is attached to a cart 14 having a frame 16 and four wheels 18 (note that only three of the wheels are shown in FIG. 1). It should be appreciated that wheels 18 allow medical table 10 to be easily rolled and moved from one location to another. It should further be understood that support member 20 can include a vertical lifting mechanism (not shown). Such a lifting mechanism allows height adjustments of medical table 10 to be made to match the height of an adjoining surface to which, or from which, a patient is to be transferred.

Bed shell 12 includes a rectangular shaped, substantially planar base 22. Base 22 has the appropriate dimensions to fully support a patient positioned on medical table 10. Bed shell 12 also includes a side wall 24 and a side wall 26, each upwardly extending from a longitudinal edge of base 22. Bed shell 12 further includes an end wall 27 upwardly extending from an end edge 29 of base 22. (Note that in FIGS. 1 and 2, end wall 27 has been removed from medical table 10 for clarity of description.) End wall 27 is connected to side wall 24 and side wall 26. Note that end wall 27 is only shown connected to medical table 10 in FIG. 3. Bed shell 12 also includes an end wall 28 upwardly extending from an end edge of base 22 located opposite to end edge 29. End wall 28 is connected to side wall 24 and side wall 26 as shown in FIG. 1. Having bed shell 12 constructed in the above described manner results in base 22, side wall 24, side wall 26, end wall 27 and end wall 28 defining a substantially rectangular receptacle 37.

As shown in FIGS. 1 and 2, roller-belt complex 30 is contained within receptacle 37. Roller-belt complex 30 includes one cylindrically shaped prime roller 33 located adjacent to side wall 26 and one cylindrically shaped end roller 49 located adjacent to side wall 24 (see FIG. 1). Roller-belt complex 30 also includes a plurality of cylindrically shaped secondary rollers 34 contained within receptacle 37 and interposed between prime roller 33 and end roller 49. Prime roller 33, end roller 49 and each secondary roller 34 has a cylindrically shaped outer portion 39. Hereinafter prime roller 33, end roller 49 and secondary rollers 34 will be collectively referred to as "the rollers".

The rollers are arranged relative to base 22 such that their longitudinal axes are in a substantially parallel relationship. Moreover, the rollers have a lengthwise dimension such that they extend along the entire length of base 22. Also, the rollers are arranged on base 22 such that their exterior portions 39 (see FIG. 2) collectively define a bed surface for supporting a patient thereon.

Roller-belt complex 30 also includes a belt 32 disposed around the rollers. A portion of belt 32 has been removed in FIG. 1 to illustrate the cylindrical nature of the rollers. It should be understood that the width of belt 32 is substantially equal to the length of the rollers. Thus, belt 32 defines a platform surface 31 for receiving a patient thereon.

As more clearly shown in FIG. 2, belt 32 is disposed around the rollers in such a way that it frictionally engages outer portion 39 of prime roller 33. Belt 32 is also disposed around the rollers in such a way that it frictionally engages outer portion 39 of end roller 49. Therefore, as prime roller 33 is rotated around its longitudinal axis by a motor M (see FIG. 4) in a clockwise direction as indicated by arrow 40, belt 32 is forced to rotate around a path defined by the rollers in the directions indicated by arrows 42 and 44. As a result of the above described rotation of belt 32, platform surface 31 moves in the direction indicated by arrow 42 (i.e. toward side wall 26). Thus, any object, such as a patient, placed on platform surface 31 will also move in the direction indicated by arrow 42. It should be understood that motor M (see FIG. 4) is capable of switching between rotating prime roller 33 in a clockwise direction and a counter-clockwise direction.

Figure 4:
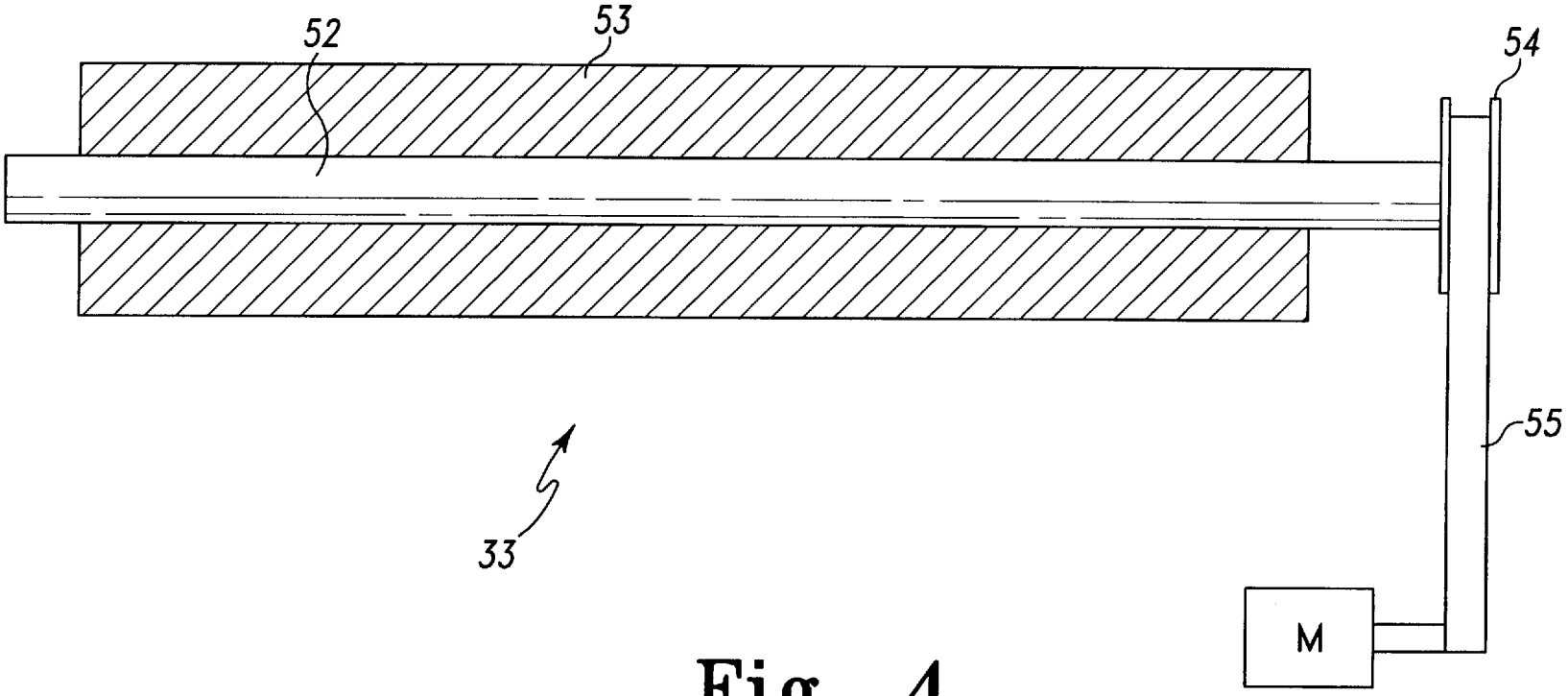
FIG. 4 is a cross sectional view of a prime roller of the medical table of FIG. 1, having a shaft disposed therein and a pulley attached to one end of the shaft (note: the pulley and portions of the shaft are not shown in cross section for clarity of description and the prime roller is schematically shown coupled to a motor)

Now referring to FIG. 4, prime roller 33 includes a substantially cylindrical member 53 made out of an elastomeric material such as rubber. Prime roller 33 also contains a shaft 52 positioned in coaxial relationship with cylindrical member 53. Shaft 52 is secured to cylindrical member 53 such that no relative rotational movement occurs between these two elements. An end of shaft 52 is attached to a pulley 54. Pulley 54 is attached to shaft 52 such that no relative rotational movement occurs between these two elements.

Figure 13:
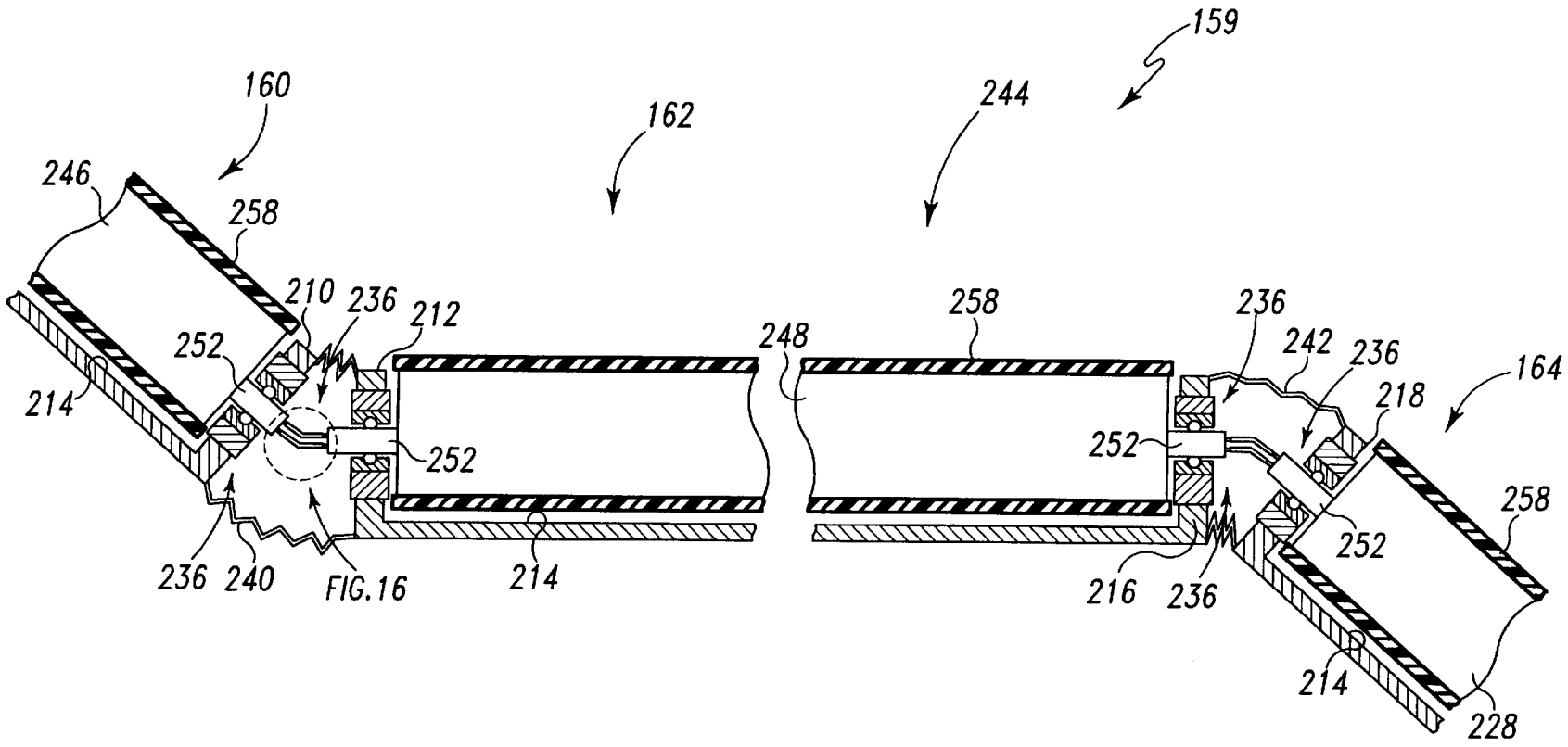
FIG. 13 is an enlarged cross sectional view similar to that shown in FIG. 12, with the prime roller removed to show a secondary roller.

A ball-bearing bracket (not shown) identical to a ball-bearing bracket 236 shown in FIG. 13 is mounted in end wall 28 (see FIG. 1) such that a passageway (not shown) is formed through end wall 28. The portion of shaft 52 interposed between pulley 54 and cylindrical member 53 is positioned in the passageway so that shaft 52 contacts an inner race of the ball-bearing bracket and extends through the passageway. Positioning the shaft 52 in the above described manner locates pulley 54 outside of receptacle 37 as shown in FIG. 1. It should be understood that having pulley 54 located in the above described location allows a portion of a drive band 55 to be entrained around pulley 54, while having another portion of drive band 55 operatively coupled to motor M (see FIG. 4). Having drive band 55 entrained around pulley 54 and operatively coupled to motor M, couples shaft 52 of prime roller 33 to motor M. As a result, motor M is able to rotate prime roller 33 around its longitudinal axis.

The end of shaft 52, opposite to the end attached to pulley 54, is secured to end wall 27 (see FIG. 3) by any well known mechanism that allows shaft 52 to rotate about its longitudinal axis. For example, a bracket (not shown) having a bearing surface for rotatably mounting shaft 52 can be fixed to end wall 27. Shaft 52 is mounted in the bracket such that prime roller 33 is able to rotate about its longitudinal axis.

End roller 49 is identical to prime roller 33 (see FIG. 4) with the exception that the shaft contained within end roller 49 is not attached to a pulley. One end of the shaft contained in end roller 49 is secured to end wall 27, while the other end of the shaft is secured to end wall 28. The ends of this shaft are secured to end walls 27 and 28 utilizing the same method as described above for securing an end of shaft 52 to end wall 27.

Figure 5:
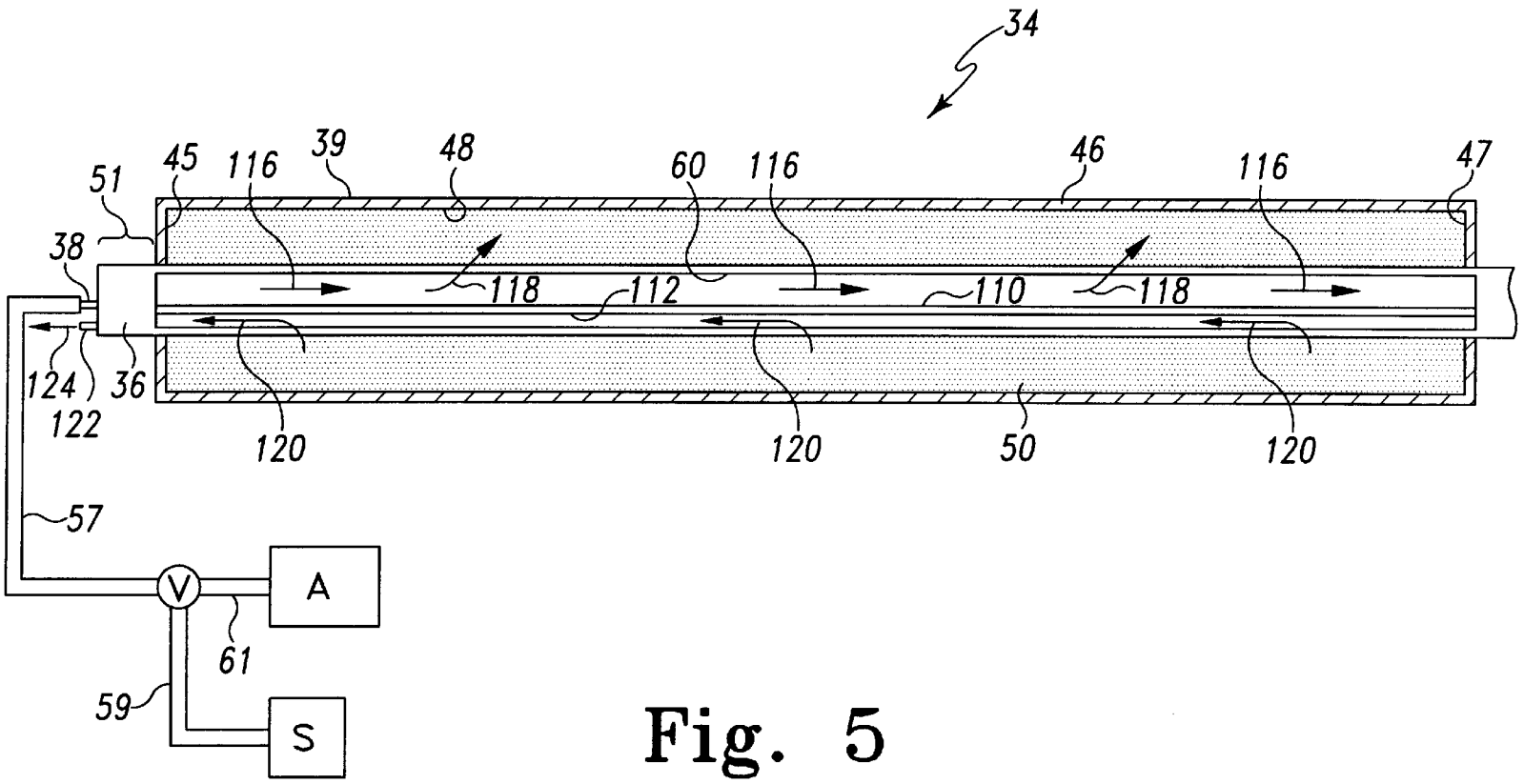
FIG. 5. is a fragmentary cross sectional view of a secondary roller of the medical table of FIG. 1, having a suction tube disposed therein (note: portions of the suction tube are not shown in cross section for clarity of description and the secondary roller is schematically shown coupled to a vacuum source and an air flow generating mechanism)
Figure 6:
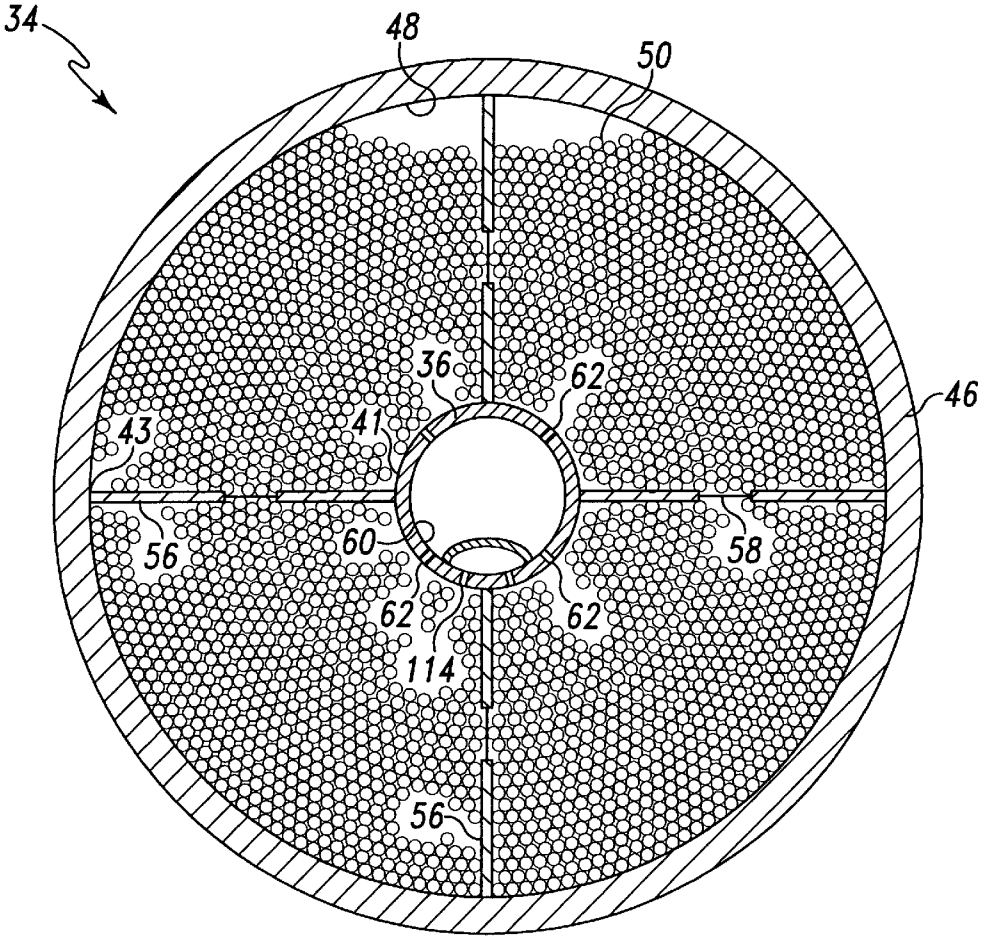
FIG. 6. is an enlarged cross sectional view of the secondary roller shown in FIG. 5.
Figure 7:
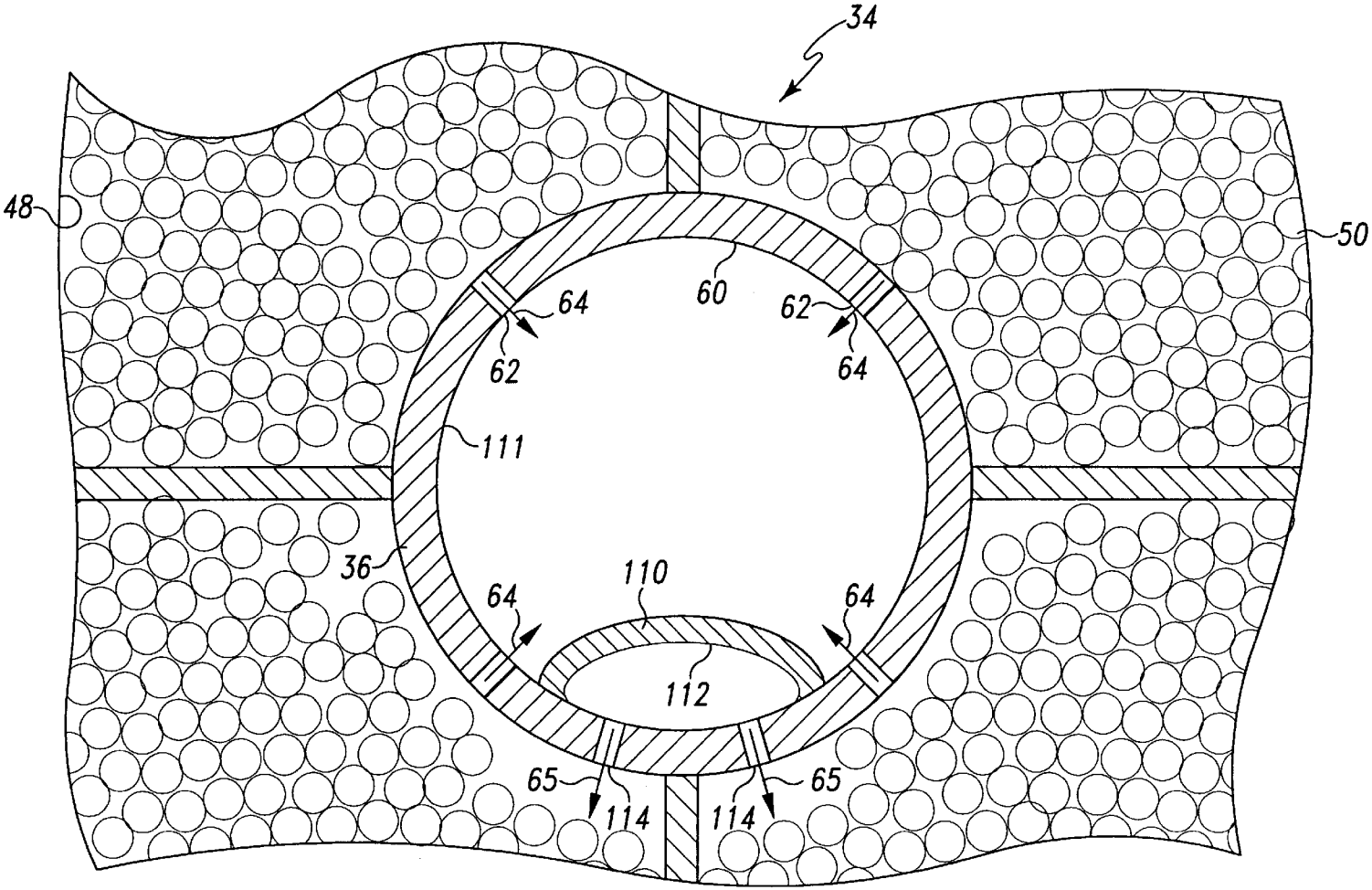
FIG. 7 is an enlarged cross sectional view of the suction tube shown in FIG. 6, with the arrows indicating the air flow going into the vacuum chamber of the suction tube.

Referring now to FIGS. 5, 6 and 7, each secondary roller 34 includes a flexible fluid impervious cylindrically shaped bag 46 having a cylindrically shaped void 48 therein. One flexible fluid impervious bag which may be used in the present invention with some modifications is described in U.S. Pat. No. 3,762,404 issued to Sakita which is herein incorporated by reference.

Each secondary roller 34 also includes a suction tube 36 contained in void 48. Suction tube 36 is located in void 48 such that suction tube 36 is in a coaxial relationship with cylindrically shaped bag 46 and is surrounded by void 48. Void 48 contains a plurality of beads 50 interposed between suction tube 36 and cylindrically shaped bag 46. Each suction tube 36 is slightly longer than the length of the cylindrically shaped bag 46 in which it is positioned. Therefore, a portion 51 (see FIG. 5) of each suction tube 36 extends out from an end of cylindrically shaped bag 46. Another portion of suction tube 36 extends out from the opposite end of cylindrically shaped bag 46.

Suction tube 36 includes a vacuum chamber 60. Vacuum chamber 60 contains a shaft cover 110 (see FIG. 7) which is attached to an interior surface 111 of suction tube 36. Shaft cover 110 and interior surface 111 define an exhaust channel 112. Shaft cover 110 and exhaust channel 112 extend the entire length of suction tube 36 and vacuum chamber 60.

As shown in FIGS. 6 and 7, suction tube 36 includes a number of ports 62 in direct fluid communication with void 48 and vacuum chamber 60. Suction tube 36 also includes a number of ports 114 in direct fluid communication with void 48 and exhaust channel 112. It should be understood that vacuum chamber 60 and exhaust channel 112 are in fluid communication only through ports 114 and 62.

Ports 62 and 114 are adapted to allow the passage of air therethrough, while preventing the passage of beads 50 into vacuum chamber 60 or exhaust channel 112, respectively. Specifically, the diameter of ports 62 and 114 can be appropriately sized to prevent the passage of beads 50 therethrough. In the alternative, a screen (not shown) having an appropriate mesh size can be placed over ports 62 and 114 and secured to suction tube 36 to prevent the entrance of beads 50 into vacuum chamber 60 and exhaust channel 112.

Each suction tube 36 is equipped with a valve 38 (see FIG. 5) which is in fluid communication with vacuum chamber 60 and therefore void 48. Valve 38 can have a well known female Luer-lock connection for attaching a hose 57 (see FIG. 5) thereto. Moreover, valve 38 may be any one of a number of valves capable of allowing the passage of air therethrough. Valve 38 must also be capable of maintaining and then releasing a vacuum. For example, valve 38 can be a conventional two way stopcock valve (not shown).

Each suction tube 36 is also equipped with a one-way valve 122 (see FIG. 5) in fluid communication with exhaust channel 112. One-way valve 122 can be any one of a number of well known check valves which only allows the flow of air therethrough in a single direction. One-way valve 122 is oriented relative to exhaust channel 112 such that it only allows air to flow out of exhaust channel 112.

Valve 38 is in fluid communication with a valve V (see FIG. 5) by way of hose 57. Valve V is in fluid communication with a vacuum source S via hose 59. Valve V is also in fluid communication with an air flow generating mechanism A via hose 61. It should be understood that valve V functions such that valve 38 is in fluid communication with either vacuum source S or air flow generating mechanism A. It should also be understood that secondary rollers 34 can be equipped with a manifold (not shown) adapted to be in fluid communication with valve 38 of each secondary roller 34. Therefore, a single hose (i.e. hose 57) can serve to place each secondary roller 34 in fluid communication with either air flow generating mechanism A or vacuum source S.

When valve V is positioned so that valve 38 of each secondary roller 34 is in fluid communication with vacuum source S, ports 62 allow the passage of air from void 48, as indicated by arrows 64 in FIG. 7, into vacuum chamber 60 while excluding beads 50. In addition, it should be understood that ports 114 allow the passage of air from exhaust chamber 112 into void 48, as indicated by arrows 65 in FIG. 7, where the air can then pass through ports 62 into vacuum chamber 60. Once in vacuum chamber 60 the air exits secondary roller 34 via valve 38. Therefore, it should be appreciated that placing valve 38 in fluid communication with vacuum source S creates a vacuum within void 48.

Any appropriate vacuum source S can be used to evacuate void 48 of secondary rollers 34. Such a vacuum source S can be manually operated or power driven. Examples of vacuum sources S which can be used in the present invention include a wall suction apparatus, aspirator pumps, or any other conveniently operating vacuum source S.

It should be understood that in a pre-evacuation state, beads 50 are substantially free to move relative to each other. As a result of the bead's ability to move relative to each other, secondary rollers 34 have a soft, pliable, bean bag-like nature.

As a vacuum is created inside each void 48, the atmospheric pressure outside of secondary rollers 34 forces beads 50 together into close interengagement. The aforementioned interengagement inhibits beads 50 from moving relative to each other. The inability of beads 50 to move relative to each other upon evacuation of void 48 causes beads 50 to form a stable rigid structure. This stable rigid structure converts secondary rollers 34 from their pre-evacuation state of being soft, pliable, bean bag-like structures, to their post-evacuation state of being stable rigid structures.

Beads 50 occupying void 48 must be sufficiently rigid to withstand the stresses that result when they interengage upon evacuation of void 48. Beads 50 must also have a high mechanical strength so that void 48 can be repeatedly evacuated without the accompanying attrition or fracture of the beads 50. Beads 50 should also be elastically deformable such that when void 48 is evacuated they can freely move into close interengagement to form a stable, rigid structure.

Beads of expanded plastic material, such as polystyrene and polyvinyl chloride are preferred because of their high mechanical strength, elastic deformability and low specific gravity. The expression "specific gravity" is intended to mean a true specific gravity. Thus, when such beads are made hollow the specific gravity of the beads is represented by its weight divided by its total volume including the hollow space therein. The specific gravity of the beads used in the present invention are preferably in the range of from about 0.1 to about 0.6. Such values are readily attainable with foamed synthetic resins, although other material can be used for beads 50 when they have a low specific gravity in the range specified above and satisfy the mechanical strength and elastic deformability requirements.

Beads 50 used in the present invention have a diameter ranging from about 1 to about 5 millimeters. Moreover, beads which are uniform in size and shape can be used, but a mixture of substantial portions of beads of at least two materially different sizes within the indicated range can also be used.

It should be understood that the rigidity or softness of secondary rollers 34 is dependent upon the amount of air removed from void 48. For example, if only a relatively small amount of air is removed from void 48, i.e. a "partial vacuum" is formed in void 48, the secondary roller 34 will be more rigid as compared to its pre-evacuation state, but will not be as rigid as compared to when substantially all of the air is removed from void 48. Therefore, the degree of rigidity or hardness of secondary rollers 34 (and therefore the hardness of platform surface 31) can be adjusted based upon the amount of air removed from void 48. Therefore, the degree of rigidity or hardness of secondary rollers 34 (and therefore the hardness of platform surface 31) can be adjusted based upon a patient's 66 (see FIG. 10) preference. This is an important aspect of the present invention since adjusting the rigidity or hardness of secondary rollers 34 to a patient's preference will enhance that patient's comfort during a medical procedure taking place on medical table 10.

Figure 8:
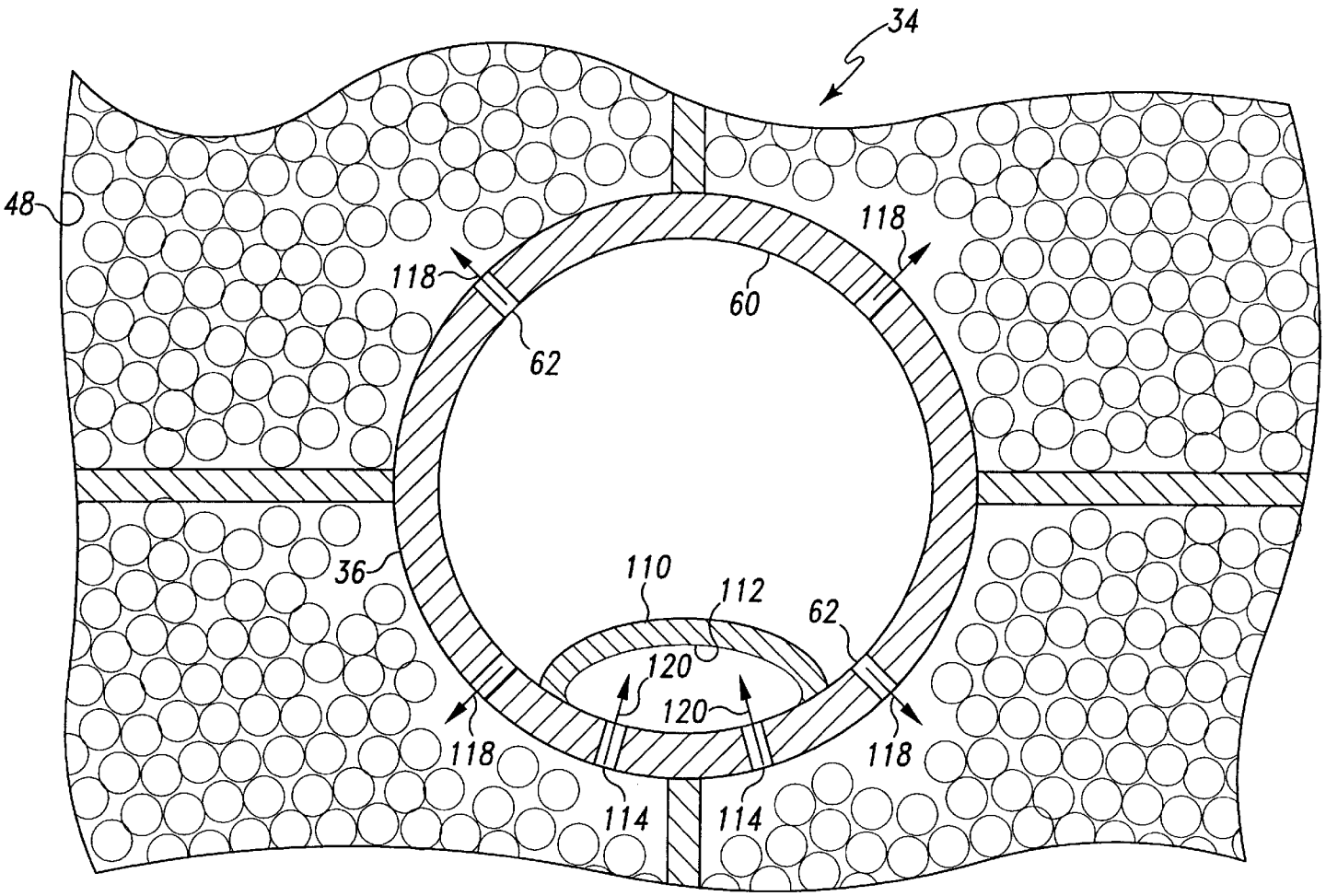
FIG. 8 is an enlarged cross sectional view of the suction tube shown in FIG. 6, with the arrows indicating the air flow going out of the vacuum chamber of the suction tube.

When valve V is positioned so that valve 38 is in fluid communication with air flow generating mechanism A, air flows through valve 38 into vacuum chamber 60 as indicated by arrows 116 (see FIG. 5). Once in vacuum chamber 60 the air passes through ports 62 into void 48 as indicated by arrows 118 in FIGS. 5 and 8. After exiting vacuum chamber 60 the air circulates throughout void 48 and then enters exhaust chamber 112 via ports 114 as indicated by arrows 120 in FIGS. 5 and 8. Once in exhaust chamber 112 the air exits secondary roller 34 via one-way valve 122 as indicated by arrow 124 in FIG. 5.

It should be understood that air flow generating mechanism A is equipped with any well known temperature control mechanism such that the temperature of the air which is circulated through secondary roller 34 can be adjusted. For example, air flow generating mechanism A can be adjusted such that warm or cool air is circulated through void 48. Circulating warm or cool air through void 48 will warm or cool secondary roller 34, respectively. Warming or cooling secondary rollers 34 will also warm or cool patient 66 (see FIG. 10) positioned on platform surface 31 (see FIG. 10). This is another important aspect of the present invention since adjusting the temperature of secondary rollers 34 to a patient's preference will enhance that patient's comfort during a medical procedure taking place on medical table 10. In addition, the ability to adjust the temperature of secondary rollers 34 may aid in the treatment of various medical conditions. For example, cooling secondary rollers 34 may aid medical personal in treating a patient suffering from a fever.

As shown in FIG. 6, secondary roller 34 also includes a number of partitions 56 secured to, and radially extending between, an outer surface 41 of suction tube 36 and an inner surface 43 of cylindrical bag 46. Partitions 56 are nearly rectangular in shape and extend along the entire length of cylindrical bag 46 and suction tube 36. Partitions 56 are secured to a first interior end surface 45 (see FIG. 5) and a second interior end surface 47 (see FIG. 5) of cylindrical bag 46. Partitions 56 can be secured to outer surface 41, inner surface 43, first interior end surface 45 (see FIG. 5) and second interior end surface 47 (see FIG. 5) with an adhesive.

Figure 9:
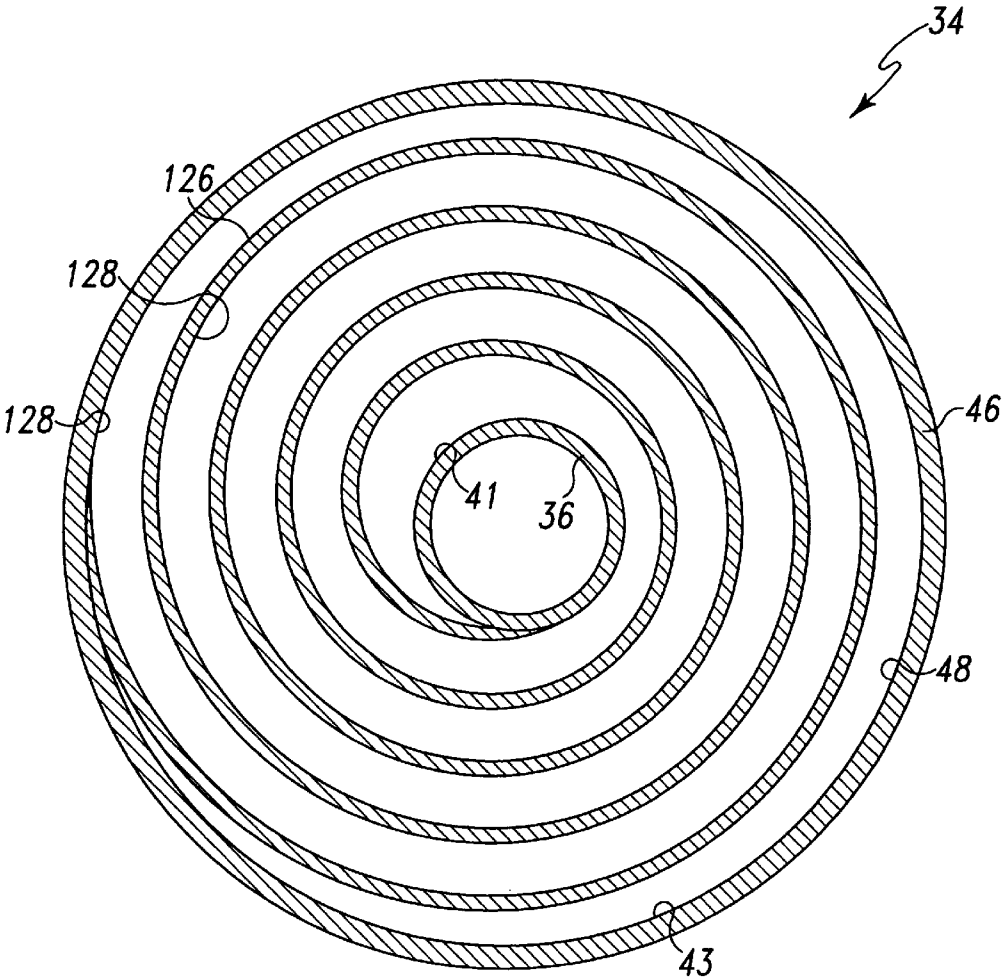
FIG. 9 is cross sectional view of an alternate embodiment of the secondary roller, with a spiral shaped compartment divider positioned within the secondary roller (note: the beads, the shaft cover and a number of ports have been removed for clarity of description)

One alternative configuration of secondary roller 34 is shown in FIG. 9, instead of partitions 56, secondary roller 34 can include a spiral-shaped compartment divider 126 positioned within void 48. Note that in FIG. 9, beads 50, shaft cover 112 and a number of ports 62 and 114 have been removed for clarity of description. Compartment divider 126 creates a spiral-shaped compartment 128 within void 48. Compartment divider 126 is secured to outer surface 41, inner surface 43, first interior end surface 45 (see FIG. 5) and second interior end surface 47 (see FIG. 5) with any appropriate adhesive.

Having partitions 56 or compartment divider 126 secured and arranged in the aforementioned manner functions to confine beads 50 within a number of compartments created in void 48. Having beads 50 confined to a number of compartments within void 48 prevents beads 50 from being redistributed by gravity as secondary roller 34 is rotated around its longitudinal axis. Partitions 56 or compartment divider 126 also prevents beads 50 from being redistributed by any movement they are subjected to prior to evacuation of void 48. Preventing the redistribution of beads 50 maintains the cylindrical shape of secondary roller 34.

Furthermore, having partitions 56 or compartment divider 126 attached to inner surface 43 of cylindrical bag 46 and outer surface 41 of suction tube 36 facilitates the simultaneous rotation of cylindrical bag 46 with suction tube 36.

Referring back to FIG. 6, each partition 56 has a screen 58 mounted therein which is adapted to allow the flow of a fluid therethrough but prevents a flow of beads 50 from one compartment to another. Thus, all the compartments within void 48 are in fluid communication with one another, which facilitates circulation of air through void 48 when void 48 is in fluid communication with air flow generating mechanism A.

In an alternative embodiment, secondary roller 34 can be constructed in an identical manner as described above, with the exception that no beads 50 are interposed between suction tube 36 and cylindrically shaped bag 46. In addition, one-way valve 122 (see FIG. 5) is replaced with a valve similar to valve 38 described above, i.e. a conventional two way stop cock valve. When no beads 50 are interposed between suction tube 36 and cylindrically shaped bag 46, the rigidity of secondary roller 34 is increased by introducing air into void 48 via air flow generating mechanism A, while the two way stop cock valve corresponding to valve 122 (see FIG. 5) is closed (i.e. no air can exit void 48 through the valve). Introducing air into void 48 in the above described manner causes cylindrically shaped bag 46 (and therefore secondary roller 34) to inflate and thus become a stable rigid structure.

Preferably, secondary rollers 34 are inflated in the above described manner prior to rotation of belt 32 (see FIG. 2) since having secondary rollers 34 inflated facilitates the rotation of belt 32 around the path defined by prime roller 33, end roller 49 and secondary rollers 34. In addition, secondary rollers 34 can be inflated when patient 66 positioned thereon (see FIG. 10) prefers a relatively rigid or hard bed surface.

On the other hand, if the patient 66 prefers a relatively soft bed surface, the two way stop cock valve can be opened thus allowing a portion of the air contained within void 48 to exit secondary roller 34. Allowing a portion of the air to exit void 48 will deflate secondary roller 34 and thus cause secondary roller 34 to become a relatively soft, pliable structure.

Now referring back to FIG. 3, end wall 27 has a number of ball-bearing brackets 75 mounted therein. Ball-bearing brackets 75 mounted in end wall 27 are identical to ball-bearing brackets 236 shown in FIG. 13. Portion 51 (see FIG. 5) of each suction tube 36 contained in secondary rollers 34 is positioned within a ball-bearing bracket 75. Portion 51 is positioned within ball-bearing bracket 75 in a manner identical to that shown in FIG. 13 with respect to one end of suction tube 252 and ball-bearing bracket 236. Specifically, portion 51 is positioned within ball-bearing bracket 75 such that portion 51 is in contact with an inner race of ball-bearing bracket 75 and extends through end wall 27. Having portion 51 positioned in the above described manner locates valve 38 outside of receptacle 37 (see FIG. 2) and thus facilitates the attachment of a manifold or hose 57 to valve 38.

The end of suction tube 36 opposite to portion 51 is secured to end wall 28 (see FIG. 1) by a mechanism that allows suction tube 36 to rotate about its longitudinal axis. For example, a bracket (not shown) having a bearing surface for rotatably mounting suction tube 36 can be fixed to end wall 28. Suction tube 36 is mounted in the bracket such that secondary roller 34 is able to rotate about its longitudinal axis.

Figure 10:
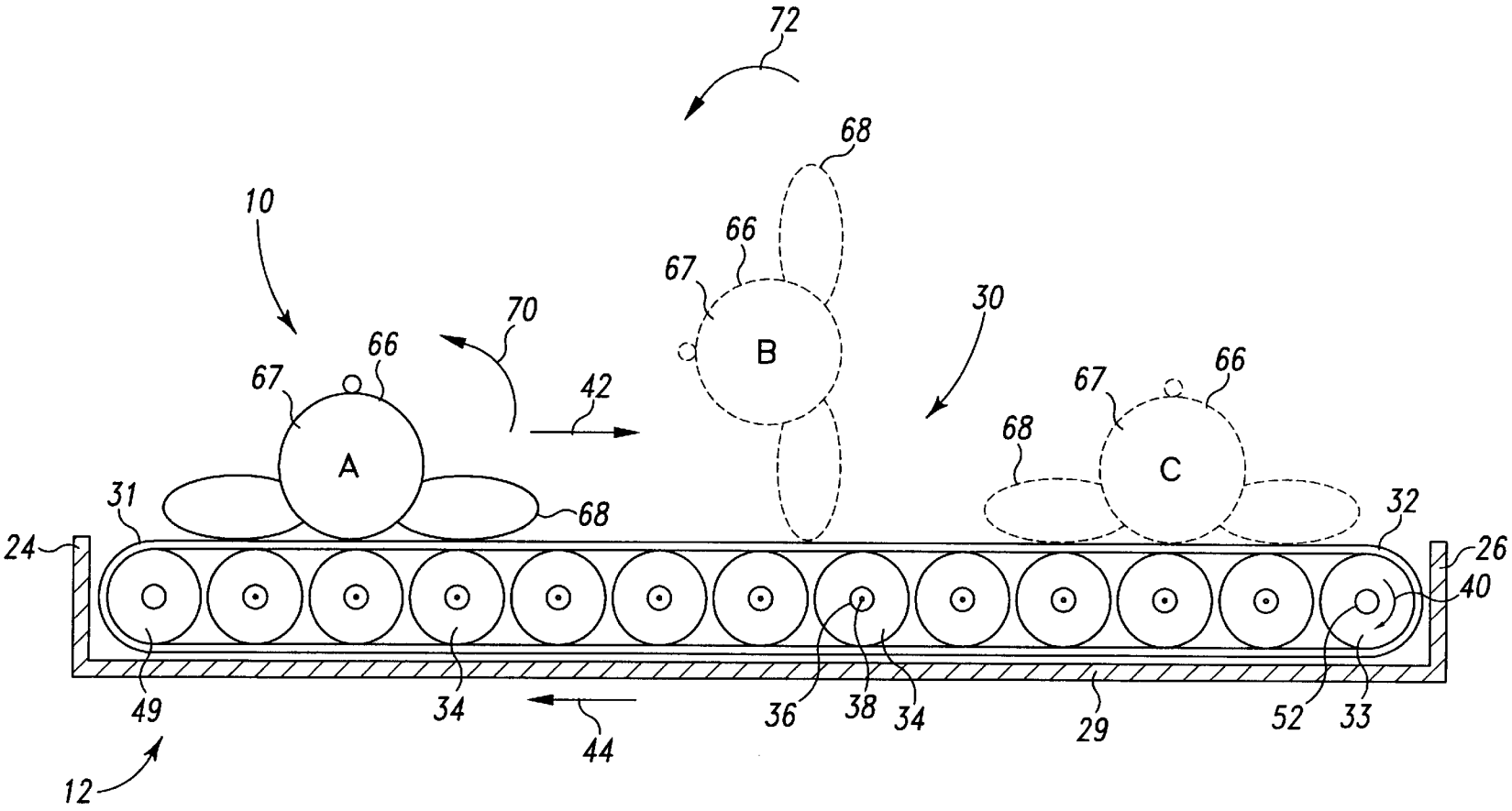
FIG. 10 is an elevational view of an end of the medical table shown in FIG. 1, with the medical table shown having a patient disposed thereon which is being moved from a first position to a second position (note: the size of the patient is reduced relative to the size of the medical table for clarity of description)

Now referring to FIG. 10, there is shown three sequential views, A, B and C, of a patient 66 supported on platform surface 31 of medical table 10. Note that the size of the patient is reduced relative to the size of medical table 10 for clarity of description. Patient 66 is supported on platform surface 31 such that the top of the patient's head 67 is positioned adjacent to end edge 29. Note that in FIG. 10 end wall 27 has been removed for clarity of description. View A illustrates patient 66 lying in a supine position (i.e. lying face upward). View B illustrates patient 66 lying in a lateral position (i.e. lying on a side). View C illustrates patient 66 lying in a prone position (i.e. lying face downward). How medical table 10 functions to aid in positioning patient 66 from supine position A to prone position C is discussed in detail below. However, it should be understood that table 10 can also be used to aid in positioning patient 66 in other positions as well.

Patient 66 is supported on platform surface 31 in supine position and motor M (see FIG. 4) is actuated, thereby rotating prime roller 33 in a clockwise direction as indicated by arrow 40. The frictional engagement of belt 32 with prime roller 33 causes belt 32 to rotate about prime roller 33, end roller 49 and secondary rollers 34 in the directions indicated by arrows 42 and 44. The rotation of belt 32 causes platform surface 31 to move in the direction indicated by arrow 42, therefore patient 66 also moves in the direction indicated by arrow 42. As patient 66 moves in the aforementioned direction, his or her shoulder 68 is gently lifted off of platform surface 31 by medical personnel (not shown) in the direction indicated by arrow 70. The medical personnel continues to lift and support shoulder 68 until patient 66 is disposed in lateral position B. Once in lateral position B, shoulder 68 of patient 66 is gently lowered toward platform surface 31 by the medical personnel in the direction indicated by arrow 72 until patient 66 is disposed in prone position C. It should be understood that other portions of the patient's 66 body, such as a hip (not shown), can be lifted and moved in a similar manner as that described for shoulder 68 to facilitate the repositioning of patient 66.

Once patient 66 is disposed in prone position C, motor M is switched off, thereby stopping the movement of platform surface 31. Once motor M is switched off and secondary rollers 34 stop rotating, each valve 38 can be placed in fluid communication with either vacuum source S or air flow generating mechanism A (see FIG. 5). Once each valve 38 is in fluid communication with either vacuum source S or air flow generating mechanism A the rigidity or temperature of secondary rollers 34 can be adjusted to the patient's 66 preference as previously discussed.

Figure 11:
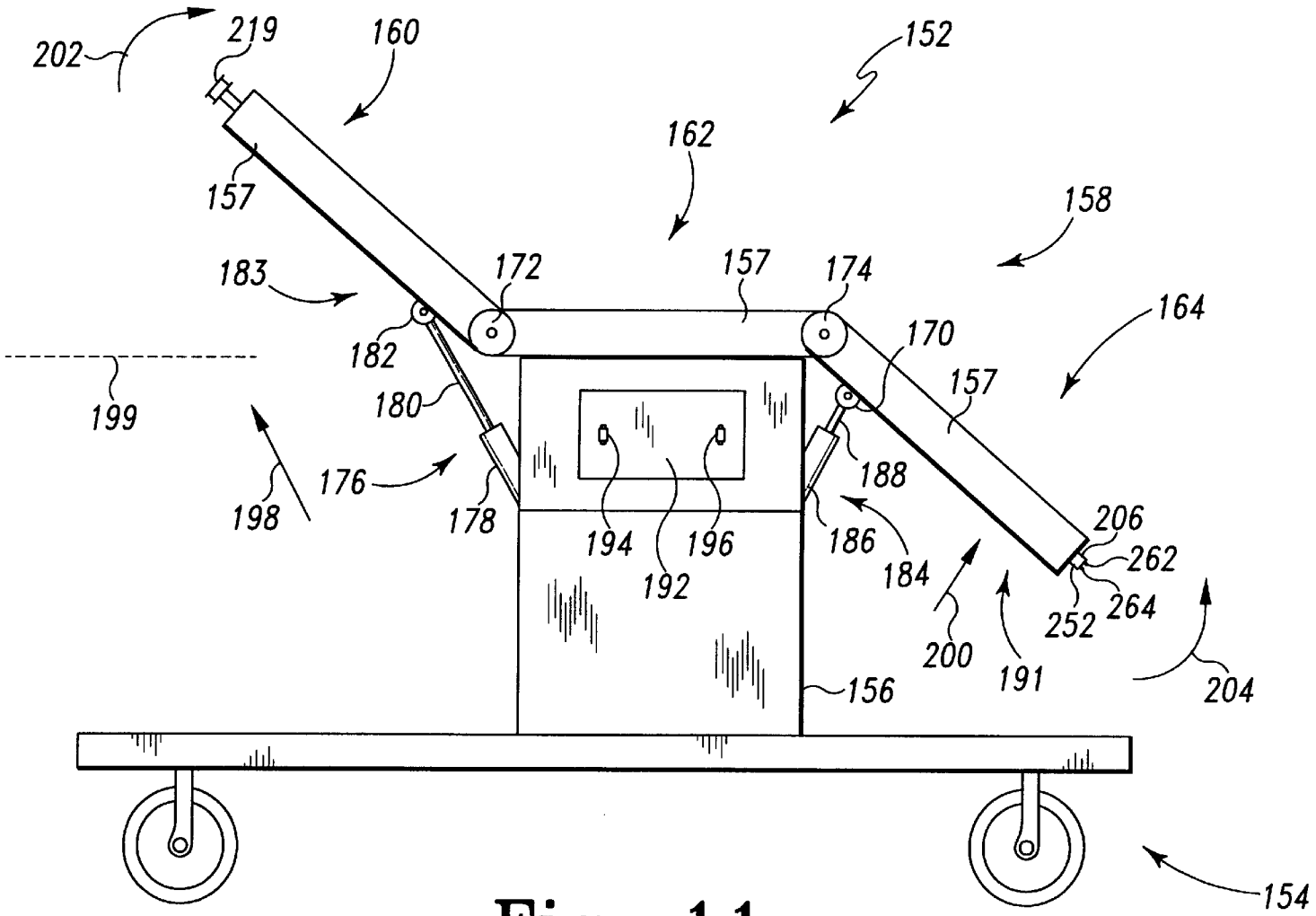
FIG. 11 is a side elevational view of a medical table similar to the one shown in FIG. 1, but having the bed shell divided into a number of movable segments.

As shown in FIG. 11, a medical table 152 capable of positioning a patient's torso and/or legs (not shown) at an angle relative to a horizontal axis 199 is also contemplated. Medical table 152 is similar to medical table 10 in that it includes a cart 154 having a number of wheels, and a support member 156 mounted on cart 154. Medical table 152 also includes a bed shell 158 mounted on support member 156. Medical table 152 further includes a roller-belt complex 159 (see FIGS. 12 and 13) contained within bed shell 158. However, unlike medical table 10 described above, bed shell 158 and roller-belt complex 159 of medical table 152 are divided into a number of segments.

Figure 12:
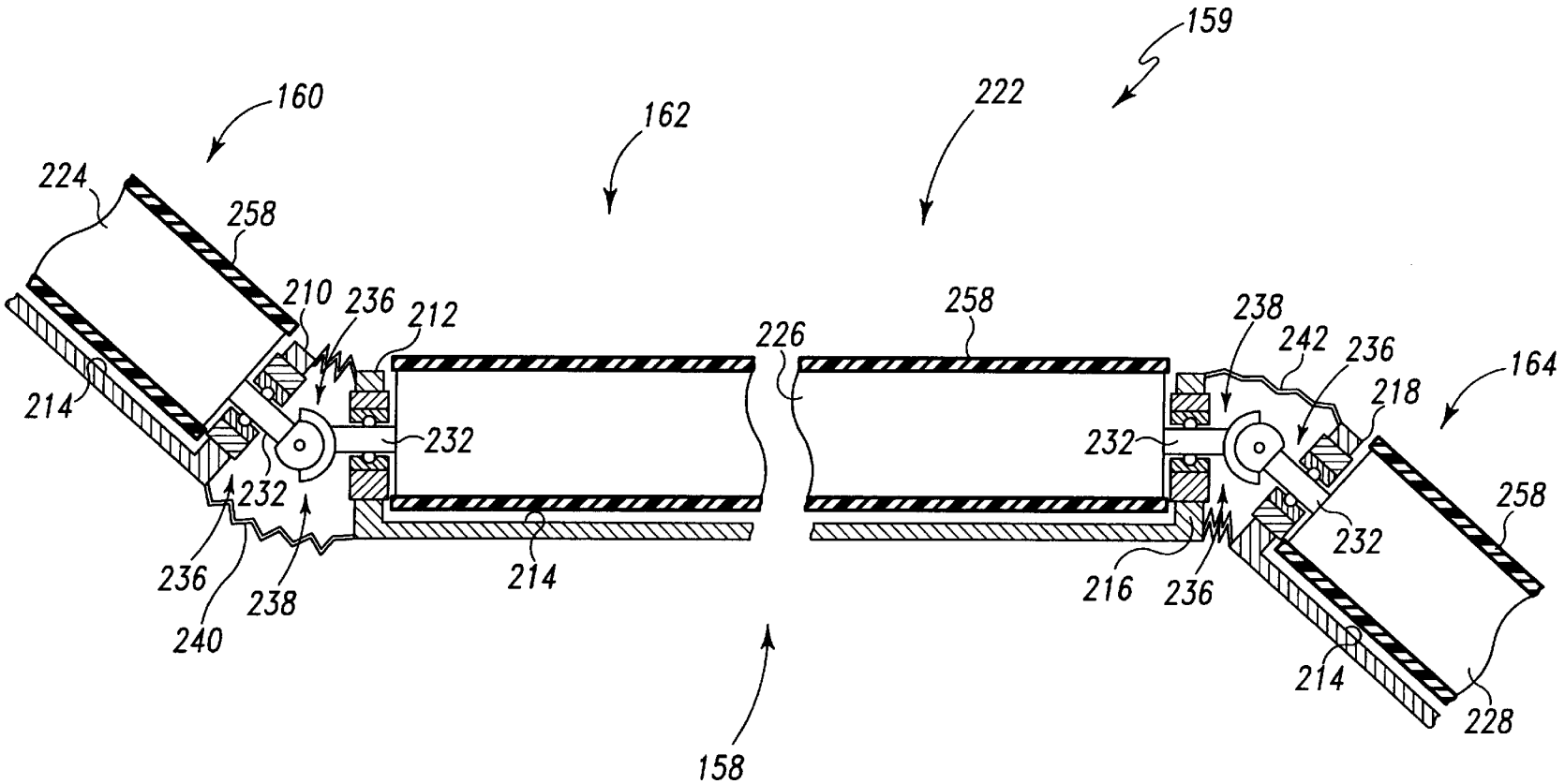
FIG. 12 is an enlarged cross sectional view of the medical table shown in FIG. 11, with a side wall of the bed shell removed to show the prime roller.

As shown in FIGS. 11, 12 and 13, bed shell 158 is divided into a left segment 160, a center segment 162, and a right segment 164. Note that side wall 157 has been removed in FIGS. 12 and 13 for clarity of description. Left segment 160 includes two end walls, however, only end wall 210 is shown in FIGS. 12 and 13. End wall 210 has a number of ball-bearing brackets 236 mounted therein. The other end wall of left segment 160 has a single ball-bearing bracket (identical to ball-bearing bracket 236) mounted therein. It should be understood that ball-bearing brackets 236 provide a passageway through each end wall in which they are mounted.

Center segment 162 includes an end wall 212 and an end wall 216. Both end wall 212 and end wall 216 of center segment 162 have ball-bearing-brackets 236 mounted therein. Center segment 162 is secured to support member 156.

Right segment 164 also includes two end walls, however, only end wall 218 is shown in FIGS. 12 and 13. Both end walls of right segment 164 have ball-bearing brackets 236 mounted therein.

Left segment 160, center segment 162 and right segment 164 each define a substantially rectangular receptacle 214 similar to receptacle 37 described in reference to medical table 10. Left segment 160 is pivotally secured to center segment 162 via pivot joint 172 (see FIG. 11). Right segment 164 is pivotally secured to center segment 162 via pivot joint 174 (see FIG. 11).

Medical table 152 also includes a mechanism for positioning left segment 160 and right segment 164 at an angle relative to horizontal axis 199. One mechanism for positioning left segment 160 and right segment 164 which may be used in the present invention with some modifications is described in U.S. Pat. No. 3,967,328 issued to Cox the disclosure of which is herein incorporated by reference. The mechanism for positioning left segment 160 and right segment 164 includes a left hydraulic cylinder 176 and a right hydraulic cylinder 184. Left hydraulic cylinder 176 includes a housing 178 attached to support member 156. Left hydraulic cylinder 176 also includes a movable rod 180 which is positioned within housing 178. An end of movable rod 180 is secured to an ear 182. Ear 182 is attached to an underportion 183 of left segment 160.

Extension of movable rod 180 out of housing 178 in a direction indicated by arrow 198 causes left segment 160 to move in a direction indicated by arrow 202. Retraction of movable rod 180 into housing 178 in a direction opposite to the direction indicated by arrow 198 causes left segment 160 to move in a direction opposite to the direction indicated by arrow 202. Movement of movable rod 180 in the above described manner results in left segment 160 being positioned at various angles relative to horizontal axis 199. However, it should be understood that movable rod 180 can be moved such that left segment 160 is in a substantially parallel relationship with horizontal axis 199.

Right hydraulic cylinder 184 includes a housing 186 attached to support member 156. Right hydraulic cylinder 184 also includes a movable rod 188 which is positioned within housing 186. An end of movable rod 188 is secured to an ear 190. Ear 190 is attached to an under-portion 191 of right segment 164.

Extension of movable rod 188 out of housing 186 in a direction indicated by arrow 200 causes right segment 164 to move in a direction indicated by arrow 204. Retraction of movable rod 188 into housing 186 in a direction opposite to the direction indicated by arrow 200 causes right segment 164 to move in a direction opposite to the direction indicated by arrow 204. Movement of movable rod 188 in the above described manner results in right segment 164 being positioned at various angles relative to horizontal axis 199. However, it should be understood that movable rod 188 can be moved such that right segment 164 is in a substantially parallel relationship with horizontal axis 199.

The mechanism for positioning left segment 160 and right segment 164 also includes a control panel 192 secured to support member 156. Control panel 192 includes a left control lever 194 and a right control lever 196. Left control lever 194 is operatively linked to left hydraulic cylinder 176 such that movement of left control lever 194 actuates movable rod 180 in the above described manner. Right control lever 196 is operatively linked to right hydraulic cylinder 184 in a similar fashion.

As shown in FIGS. 12 and 13, elements of roller-belt complex 159 are divided into a number of segments. Prime roller 222, including shaft 232, is divided into a left portion 224, a center portion 226 and a right portion 228. As shown in FIG. 12, left portion 224 is located within receptacle 214 of left segment 160. Left portion 224 is positioned in receptacle 214 such that a section of shaft 232 extends through end wall 210 and contacts an inner race of ball-bearing bracket 236. Left portion 224 is further positioned in receptacle 214 such that a section of shaft 232 extends through the end wall (not shown) opposite to end wall 210, and contacts an inner race of the ball-bearing bracket (not shown) mounted therein. Positioning left portion 224 in the above described manner locates a pulley 219 secured to an end of shaft 232 outside of receptacle 214 as shown in FIG. 11.

Center portion 226 is located within receptacle 214 of center segment 162. Center portion 226 is positioned in receptacle 214 such that a section of shaft 232 extends through end wall 212 and contacts an inner race of ball-bearing bracket 236. Center portion 226 is further positioned in receptacle 214 such that another section of shaft 232 extends through end wall 216 and contacts an inner race of ball-bearing bracket 236 mounted therein.

Right portion 228 is located within receptacle 214 of right segment 164. Right portion 228 is positioned in receptacle 214 such that a section of shaft 232 extends through end wall 218 and contacts an inner race of ball-bearing bracket 236. The end (not shown) of shaft 232 opposite to the end secured to pulley 219 (see FIG. 11) is secured to the end wall of right segment 164 opposite to end wall 218 by any well known mechanism that allows shaft 232 to rotate about each portion's (i.e. left portion 224, center portion 226 and right portion 228) longitudinal axis. For example, a bracket (not shown) having a bearing surface for rotatably mounting shaft 232 can be fixed to the end wall. Shaft 232 is mounted in the bracket such that prime roller 222 is able to rotate each portion (i.e. left portion 224, center portion 226 and right portion 228) about its longitudinal axis.

The section of shaft 232 extending through end wall 210 and the section of shaft 232 extending through end wall 212 are connected by a universal joint 238. The section of shaft 232 extending through end wall 216 and the section of shaft 232 extending through end wall 218 are also connected by a universal joint 238. Universal joints 238 allow the portions of shaft 232 (i.e. left portion 224, center portion 226 and right portion 228) to be angled relative to one another and still effectively transfer torque therebetween. Therefore, a single motor (not shown) operatively linked to left portion 224 via pulley 219 will simultaneously rotate left portion 224, center portion 226 and right portion 228 of prime roller 222.

As shown in FIGS. 12 and 13, a rubber protection member 240 is attached to end walls 210 and 212. Rubber protection member 240 surrounds a space defined between end walls 210 and 212 so that a patient positioned on medical table 152 will not come into contact with universal joint 238. Rubber protection member 240 also prevents a portion of a patients body from being pinched between end walls 210 and 212 when left segment 160 is moved relative to center segment 162. A rubber protection member 242 is also attached to end walls 216 and 218 in an identical manner for the identical purpose.

It should be understood that medical table 152 also includes an end roller (not shown). The end roller functions in a substantially similar way as described above in reference to end roller 49. The end roller included in medical table 152 is constructed in an identical manner as described above in reference to prime roller 222, with the exception that an end of the end roller is not attached to a pulley. Instead the end roller is secured to the end wall of left segment 160 opposite to end wall 210 by any well known mechanism that allows end roller to rotate about each portion's (i.e. left portion, center portion and right portion) longitudinal axis. The end roller is also secured to the end wall of right segment 164 opposite to end wall 218 by an identical mechanism.

As with prime roller 222, each secondary roller 244 (see FIG. 13), including suction tube 252 contained therein, is divided into a left portion 246, a center portion 248 and a right portion 250. Left portion 246, center portion 248 and right portion 250 includes a valve 262 and a one-way valve 264 (see FIGS. 11 and 14). Valve 262 and one-way valve 264 function in the same way as described above in reference to valves 38 and one-way valve 122. As shown in FIG. 13, left portion 246 is located within receptacle 214 of left segment 160. Left portion 246 is positioned in receptacle 214 such that a section of suction tube 252 extends through end wall 210 and contacts an inner race of a ball-bearing bracket 236. An end (not shown) of suction tube 252 is secured to the end wall of left segment 160 opposite to end wall 210 by any well known mechanism that allows suction tube 252 to rotate about its longitudinal axis. As discussed previously, a bracket (not shown) having a bearing surface for rotatably mounting suction tube 252 can be fixed to the end wall. Suction tube 252 is mounted in the bracket such that the portion of suction tube 252 located in left segment 160 is able to rotate about its longitudinal axis.

Center portion 248 is located within receptacle 214 of center segment 162. Center portion 248 is positioned in receptacle 214 such that a section of suction tube 252 extends through end wall 212 and contacts an inner race of ball-bearing bracket 236 mounted therein. Center portion 248 is further positioned in receptacle 214 such that another section of suction tube 252 extends through end wall 216 and contacts an inner race of ball-bearing bracket 236 mounted therein.

Right portion 250 is located within receptacle 214 of right segment 164. Right portion 250 is positioned in receptacle 214 such that a section of suction tube 252 extends through end wall 218 and contacts an inner race of a ball-bearing bracket 236 mounted therein. Right portion 250 is further positioned in receptacle 214 such that a section of suction tube 252 extends through the end wall (not shown) opposite to end wall 218, and contacts an inner race of the ball-bearing bracket mounted therein. Positioning right portion 250 in the above described manner locates a section 206 (see FIG. 11) of suction tube 252 outside of receptacle 214 as shown in FIG. 11. Having section 206 positioned in the above described manner locates valve 262 and one-way valve 264 (see FIG. 11) outside of receptacle 214 and thus facilitates the attachment of a manifold (not shown) or a hose (not shown) to valve 262.

Figure 14:
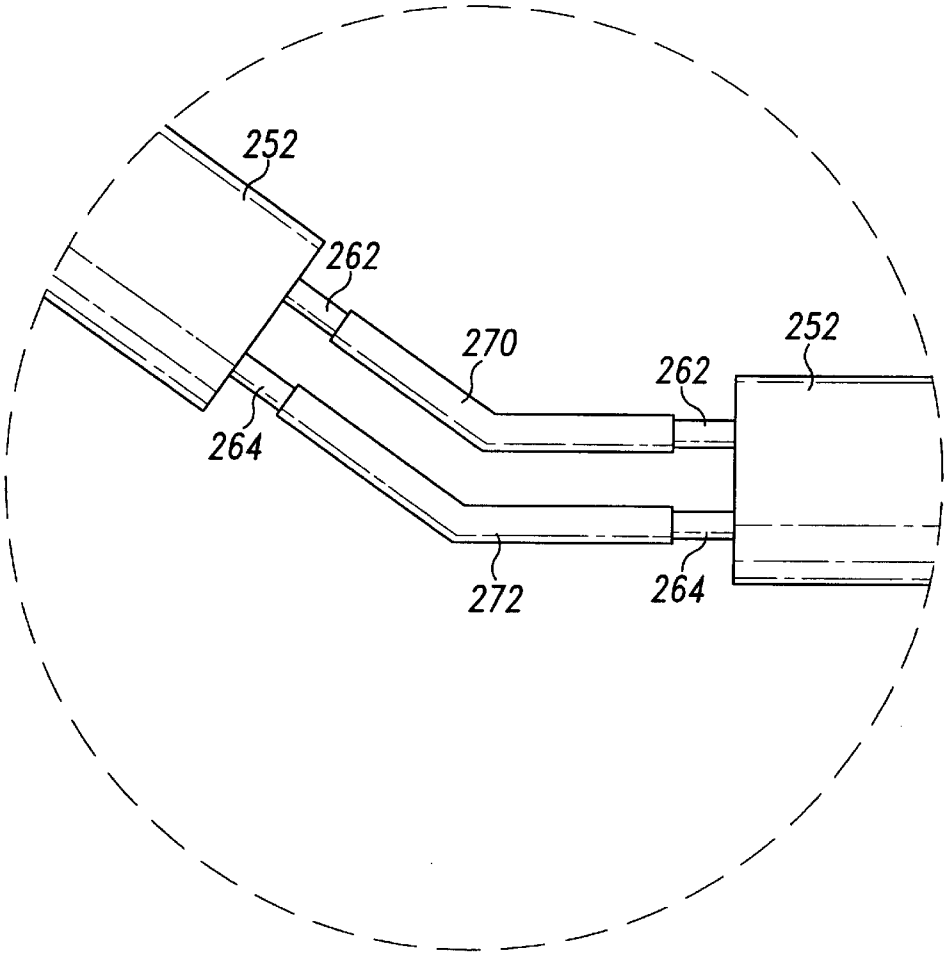
FIG. 14 is an enlarged view of a portion of FIG. 13 which is encircled and indicated as FIG. 14.

As shown in FIGS. 13 and 14, valve 262 attached to the section of suction tube 252 extending through end wall 210 and valve 262 attached to the section of suction tube 252 extending through end wall 212 are in fluid communication via a flexible hose 270. In a similar manner, valve 264 attached to the section of suction tube 252 extending through end wall 210 and valve 264 attached to the section of suction tube 252 extending through end wall 212 are in fluid communication via a flexible hose 272. Valves 262 and one-way valves 264 interposed between center portion 248 and right portion 250 are placed in fluid communication in an identical manner (i.e. utilizing flexible hoses). Therefore, valve 262 and one-way valve 264 (see FIG. 11) located out side of receptacle 214 of right segment 164 are utilized to evacuate, or circulate air through, each portion (i.e. left portion 246, center portion 248 and a right portion 250) of secondary roller 244.

It should be understood that a belt 258 is disposed around prime roller 222, secondary rollers 244 and the end roller in a manner similar to that described above in reference to belt 32, with the exception that belt 258 is also divided into left, center, and right portions as shown in FIGS. 12 and 13. Belt 258 ensures that each portion of secondary rollers 244 and each portion of the end roller rotate simultaneously with each portion of prime roller 222. Having each portion of secondary rollers 244 rotate simultaneously with each portion of prime roller 222 ensures that hoses 270 and 272 will not become twisted during use of medical table 152. Therefore, it should be appreciated that medical table 152 functions in substantially the same way as described above in reference to medical table 10. However, medical table 152 has an additional advantage of allowing a patient (not shown) placed thereon to be positioned at any one of a number of angles relative to horizontal axis 199 (see FIG. 11).

Figure 15:
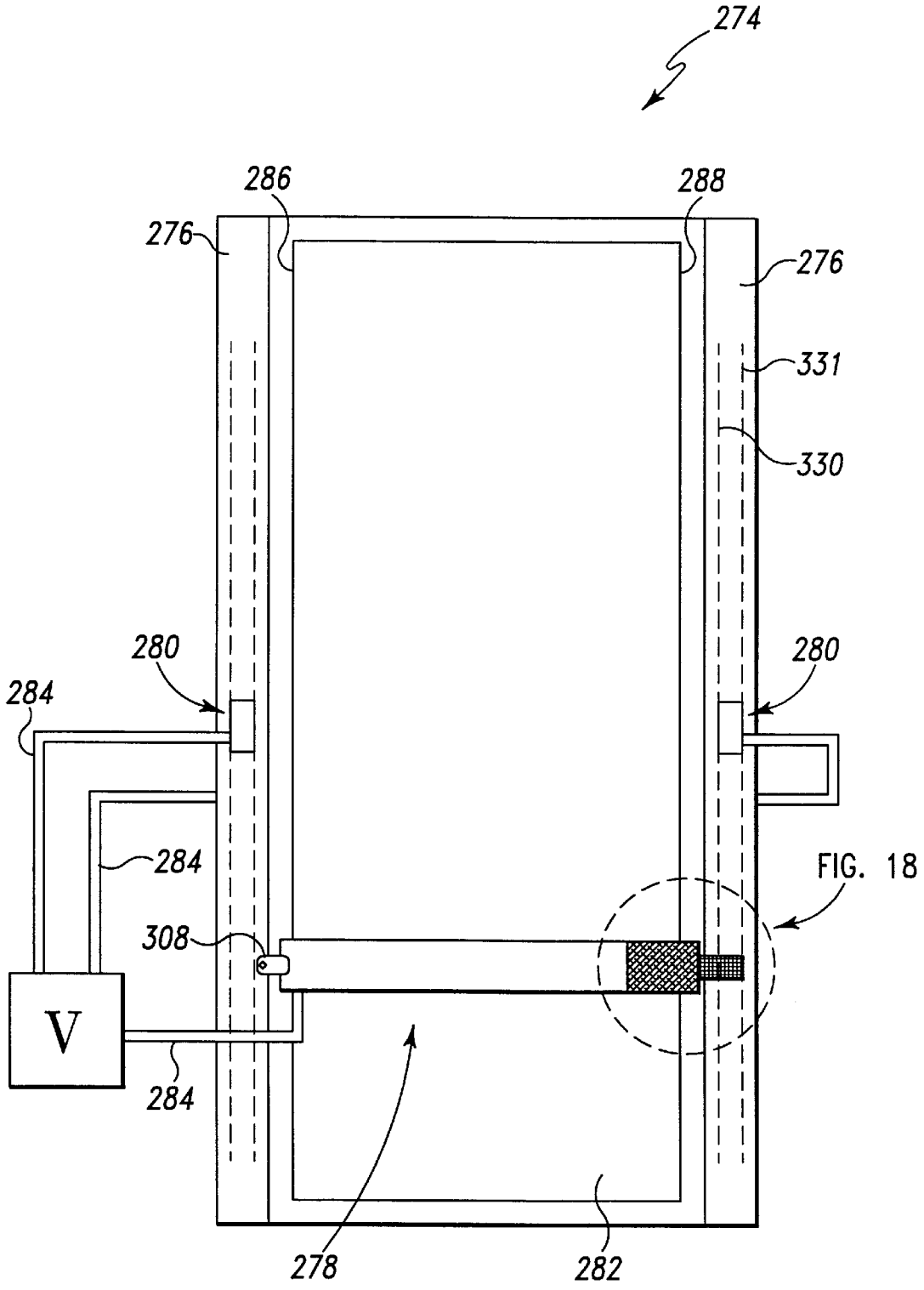
FIG. 15 is a top elevational view of a medical table assembly that incorporates the features of the invention therein.

Referring now to FIG. 15, there is shown a medical table assembly 274. Medical table assembly 274 includes a bed frame 276 having a number of slots 330 and 331 (see also FIG. 18) defined therein, a first type of restrainment apparatus 278, a pair of a second type of restrainment apparatus 280, a vacuum source V, and a buckle 322 (see FIG. 18). Medical table assembly 274 also includes a mattress 282 supported by bed frame 276. Mattress 282 has a lateral side 286 and a lateral side 288.

Figure 16:
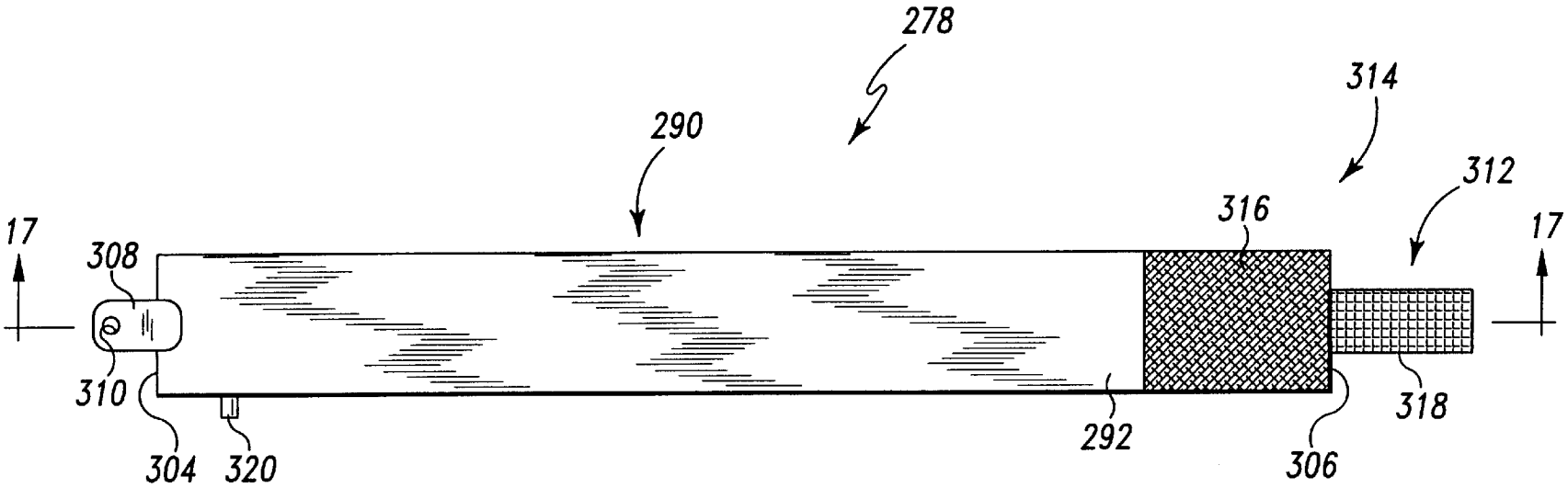
FIG. 16 is an enlarged top elevational view of one of the restrainment apparatus shown in FIG. 15.
Figure 17:
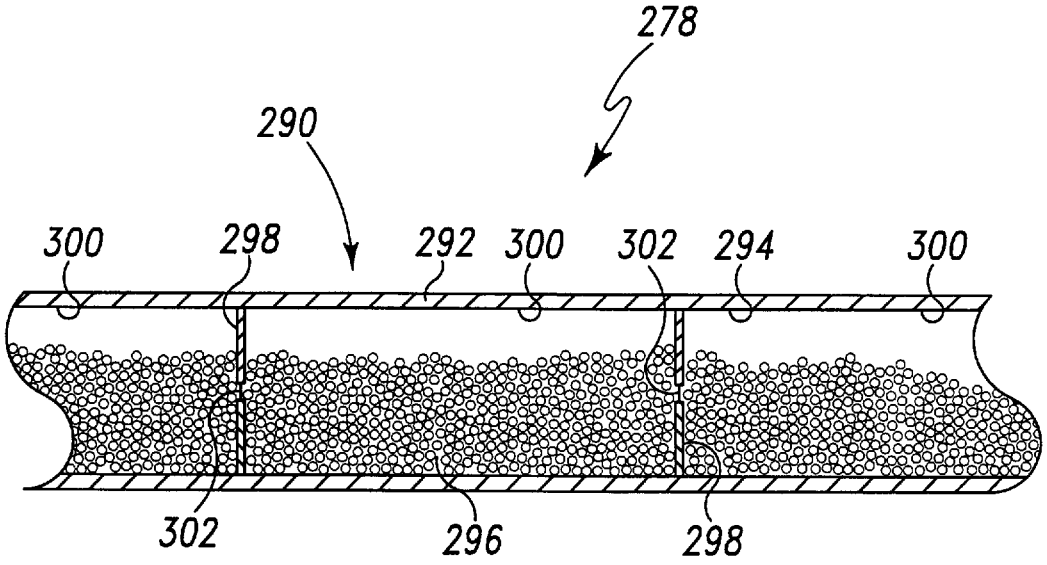
FIG. 17 is an enlarged fragmentary cross sectional view of the restrainment apparatus taken along line 17—17 of FIG. 16 as viewed in the direction of the arrows.

As shown in FIGS. 16 and 17, restrainment apparatus 278 includes a strap 290 having an end 304 and an end 306. Strap 290 includes a fluid impervious bag 292, a valve 320, a connecting member 308 having a hole 310 defined therethrough, a tab 312, and a hook and loop fastening mechanism 314 such as Velcro®.

The same type of bag (i.e. the bag described in U.S. Pat. No. 3,762,404 issued to Sakita) used to construct bag 46 of secondary rollers 34 can be used to construct bag 292. Bag 292 has a void 294 therein. Void 294 is in fluid communication with valve 320. Valve 320 is identical to valve 38 discussed above in reference to secondary rollers 34. Void 294 contains a plurality of beads 296 therein. The characteristics of beads 296 are identical to those described above in reference to beads 50.

A number of partitions 298 are contained within void 294. Partitions 298 are secured to bag 292 such that void 294 is divided into a number of compartments 300. Partitions 298 are secured to bag 292 with an adhesive.

Having partitions 298 secured and arranged in the aforementioned manner functions to confine beads 296 within the number of compartments 300 created within void 294. Having beads 296 confined within compartments 300 prevents beads 296 from being redistributed by any movement they are subjected to prior to evacuation of void 294. Preventing the redistribution of beads 296 maintains an even distribution of beads 296 in void 294.

Each partition 298 has a screen 302 mounted therein which is adapted to allow the flow of fluid therethrough but prevents a flow of beads 296 from one compartment 300 to another. Therefore, all compartments 300 within void 294 are in fluid communication with one another, and a single valve 320 can be used to evacuate all compartments 300 of void 294.

Connecting member 308 is attached to end 304 of strap 290. Tab 312 is attached to end 306 of strap 290. Hook and loop fastening mechanism 314 includes a loop portion 316 located adjacent to end 306 of strap 290 and a hook portion 318 located on tab 312.

Valve 320 is in fluid communication with vacuum source V via hose 284 as shown in FIG. 15. Evacuation of fluid (e.g. air) from void 294 with vacuum source V inhibits the relative movement of beads 296. Thus, evacuation of void 294 with vacuum source V converts restrainment apparatus 278 from its pre-evacuation state of being a soft, pliable bean bag-like structure, to its post-evacuation state of being a stable rigid structure.

Referring again to FIGS. 15 and 16, end 304 of strap 290 is secured to bed frame 276 at a position located adjacent to lateral side 286 of mattress 282 by positioning connecting member 308 in contact with bed frame 276 and screwing a bolt (not shown) through hole 310 and into bed frame 276. It should be understood that other mechanisms for conveniently securing strap 290 to bed frame 276 are contemplated such as, for example, Velcro® straps. Securing strap 290 to bed frame 276 in the above described manner positions restrainment apparatus 278 in a substantially perpendicular relationship with lateral side 286 of mattress 282.

Figure 18:
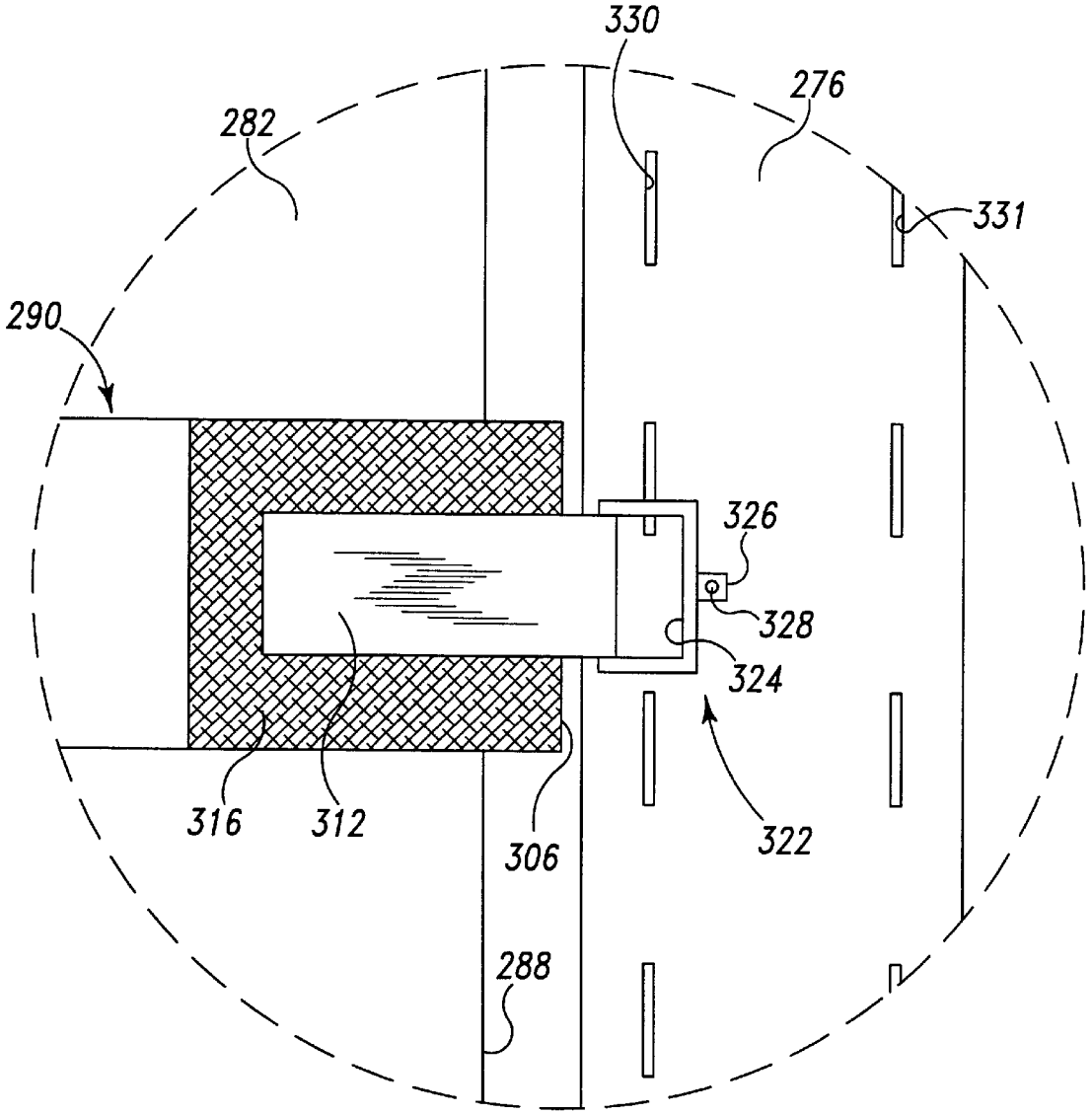
FIG. 18 is an enlarged view of a portion of FIG. 15 which is encircled and indicated as FIG. 18, which shows the tab cooperating with the buckle.

As shown in FIG. 18, buckle 322 is attached to a plate 326 having a hole (not shown) therethrough. Buckle 322 is attached to bed frame 276 at a position located adjacent to lateral side 288 of mattress 282 by positioning plate 326 in contact with bed frame 276 and screwing a screw 328 through the hole (not shown) and into bed frame 276. Tab 312 is inserted through buckle 322 via aperture 324 and positioned relative to strap 290 such that hook portion 318 (see FIG. 16) of tab 312 engages and attaches to loop portion 316. It should be appreciated that having tab 312 cooperating with buckle 322 in the above described manner secures end 306 of strap 290 to bed frame 276 at a position located adjacent to lateral side 288 of mattress 282. It should also be understood that having end 304 (see FIG. 16) and end 306 secured to bed frame 276 in the aforementioned manner positions strap 290 and thus bag 292 over mattress 282 as shown in FIG. 15.

A patient (not shown) is restrained on medical table assembly 274 (see FIG. 15) with restrainment apparatus 278 by positioning the patient between mattress 282 and strap 290. Once the patient is positioned in the above described manner, void 294 (see FIG. 17) is evacuated by vacuum source V via hose 284. Evacuation of void 294 converts restrainment apparatus 278 from its pre-evacuation state of being a soft, pliable, bean bag-like structure, to its post-evacuation state of being a stable rigid structure. Conversion of restrainment apparatus 278 from the pre-evacuation state to the post-evacuation state causes strap 290 to rapidly shrink and tighten snugly against the patient, thereby facilitating the restrainment of the patient on medical table assembly 274.

It should be appreciated that having more than one restrainment apparatus 278 cooperating to restrain a patient on medical assembly 274 is contemplated. It should also be appreciated that the rapid conversion of restrainment apparatus 278 from the pre-evacuation state to the post-evacuation state is an important aspect of the present invention since this conversion allows restrainment apparatus 278 to quickly and efficiently secure the patient to medical table assembly 274.

The patient is released from medical table assembly 274 by manipulating valve 320 to allow fluid (e.g. air) to advance back into void 294. As fluid advances back into void 294, restrainment apparatus 278 rapidly returns to its pre-evacuation state of being a soft, pliable, bean bag-like structure which causes strap 290 to slightly expand and thus loosen from the patient. The loosening of strap 290 from the patient facilitates the release of the patient from medical table assembly 274. It should be appreciated that the rapid conversion of restrainment apparatus 278 from the post-evacuation state back to the pre-evacuation state is an important aspect of the present invention since this conversion allows the patient to be quickly and efficiently released from medical table assembly 274.

Figure 19:
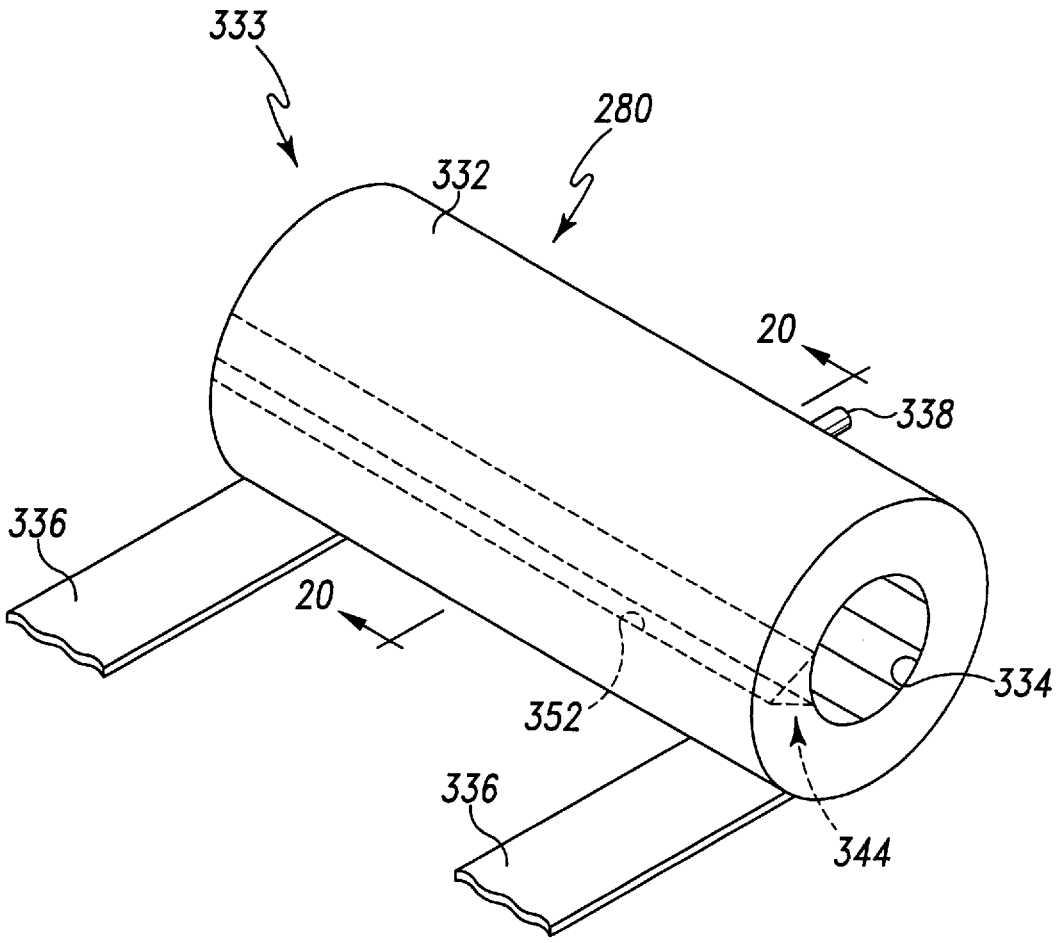
FIG. 19 is an enlarged fragmentary perspective view of the other restrainment apparatus shown in FIG. 15.
Figure 20:
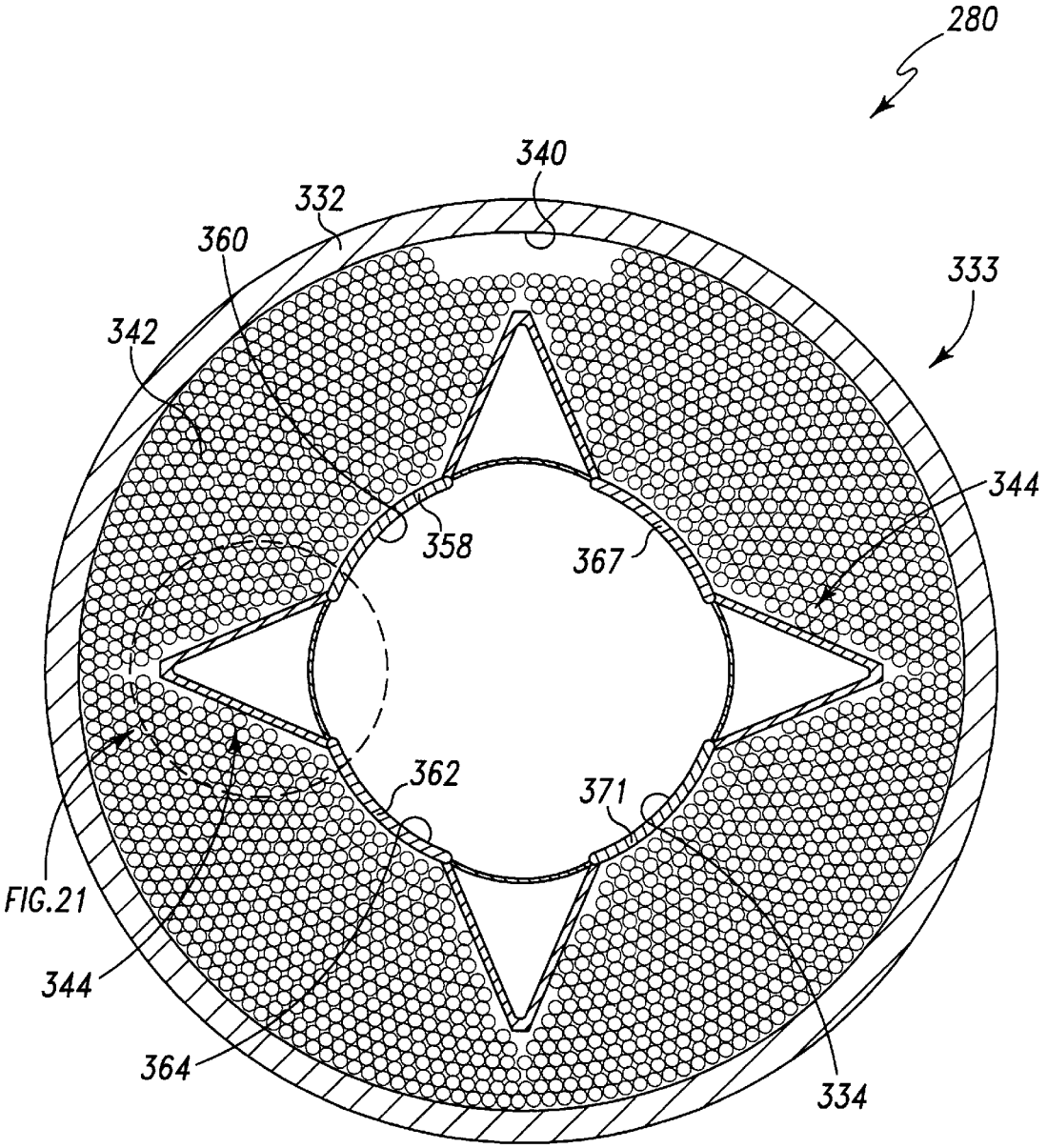
FIG. 20 is an enlarged cross sectional view of the restrainment apparatus taken along line 20—20 of FIG. 19 as viewed in the direction of the arrows, which shows the pre-evacuation position of the actuators.
Figure 21:
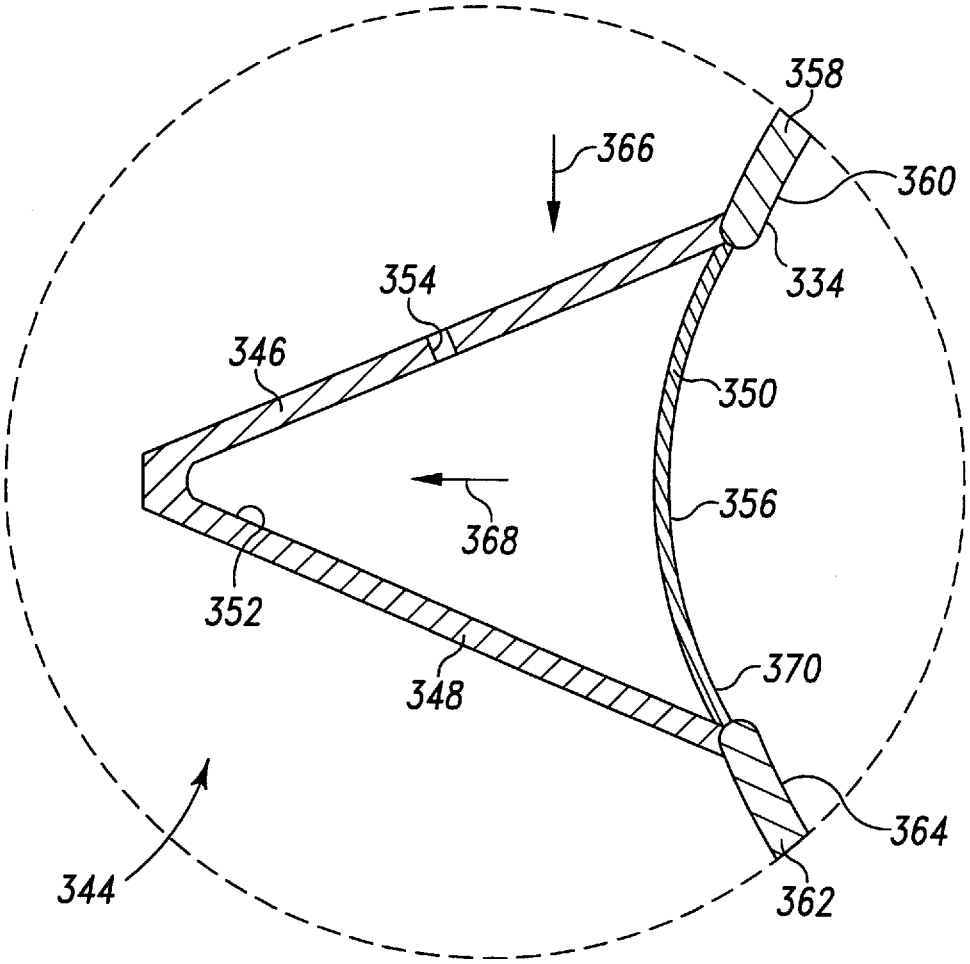
FIG. 21 is an enlarged view of a portion of FIG. 20 which is encircled and indicated as FIG. 21, with the beads removed for clarity of description.

As shown in FIGS. 19, 20 and 21, restrainment apparatus 280 includes a cylindrical member 333 having a passageway 334 extending therethrough, a number of actuators 344, a valve 338, and a number of bands 336. Restrainment apparatus 280 also includes an interior side panel 358, an interior side panel 362, an interior side panel 367, and an interior side panel 371. Each interior side panel defines a portion of passageway 334. For example, interior side panel 358 defines a portion 360 (see FIG. 20) of passageway 334. In addition, interior side panel 362 defines a portion 364 (see FIG. 20) of passageway 334. Valve 338 is identical to valve 38 discussed above in reference to secondary rollers 34. One end of each band 336 is attached to cylindrical member 333. Valve 338 is also attached to cylindrical member 333.

Restrainment apparatus 280 is mounted to medical table assembly 274 as shown in FIG. 15 by first placing cylindrical member 333 on bed frame 276 interposed between slots 330 and 331. The end of band 336 (see FIG. 19) opposite to the end attached to cylindrical member 333 is inserted down through slot 330 (see FIG. 18). The end of band 336 opposite to the end attached to cylindrical member 333 is then inserted up through the adjacent slot 331 and attached to a buckle (not shown) secured to cylindrical member 333.

As shown in FIGS. 19 and 20, cylindrical member 333 includes a fluid impervious bag 332. The same type of bag used to construct bag 46 of secondary rollers 34 can be used to construct bag 332. Bag 332 has a void 340 therein. Void 340 is in fluid communication with valve 338. Valve 338 is in fluid communication with vacuum source V via hose 284 (see FIG. 15). Void 340 contains actuators 344 and a plurality of beads 342 therein. The characteristics of beads 342 are identical to those described above in reference to beads 50.

Figure 22:
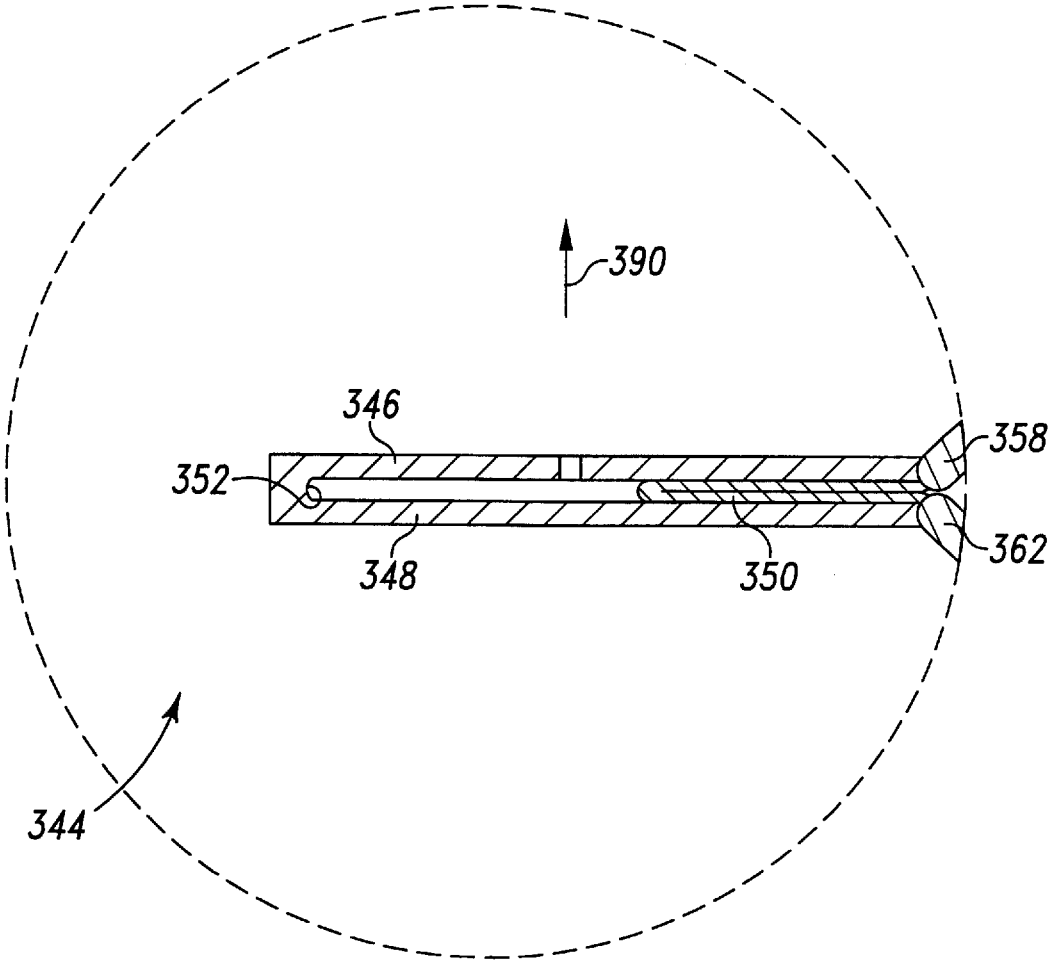
FIG. 22 is an enlarged view of a portion of FIG. 23 which is encircled and indicated as FIG. 22 with the beads removed for clarity of description, which shows the wall segment folded and positioned within the cavity of the actuator.

As shown more clearly in FIG. 21, each actuator 344 includes a wall segment 346, a wall segment 348, and a wall segment 350. Wall segment 350 defines a portion 356 of passageway 334. Wall segment 346 is pivotally attached to wall segment 348. Wall segment 346 is also attached to interior side panel 358. In a similar fashion, wall segment 348 is attached to interior side panel 362. Wall segment 350 is attached to both wall segment 346 and wall segment 348. Wall segment 350 is also attached to interior side panel 358 and interior side panel 362. Wall segment 350, interior side panel 358, and interior side panel 362 define a continuous inner surface segment 370 of passageway 334. Wall segments 346 and 348 are made from a resilient plastic material such that wall segment 346 moves toward wall segment 348 when a sufficient force is applied to wall segment 346 in a direction indicated by arrow 366 (see FIG. 21). However, wall segment 346 moves in a direction opposite to the direction indicated by arrow 366 and assumes the position shown in FIG. 21 when such force is no longer being applied to wall segment 346. Wall segment 350 is made from a flexible plastic material which allows wall segment 350 to bend and fold upon itself as shown in FIG. 22.

Wall segments 346, 348, and 350 collectively define a cavity 352. Cavity 352 substantially extends the entire length of cylindrical member 333 as shown in phantom in FIG. 19. Cavity 352 is in fluid communication with void 340 (see FIG. 20) via a port 354 (see FIG. 21). Therefore, cavity 352 is also in fluid communication with vacuum source V (see FIG. 15). It should be understood that the diameter of port 354 is configured so as to allow the passage of a fluid (e.g. air) therethrough, while preventing the passage of beads 342 into cavity 352.

Evacuation of fluid (e.g. air) from void 340 with vacuum source V inhibits the relative movement of beads 342. Thus, evacuation of void 340 with vacuum source V rapidly converts restrainment apparatus 280 from its pre-evacuation state of being a soft, pliable, bean bag-like structure, to its post-evacuation state of being a stable rigid structure.

Since cavity 352 is in fluid communication with void 340 via port 354, evacuation of void 340 simultaneously evacuates cavity 352. As a vacuum is created inside cavity 352, wall segment 350 collapses into cavity 352 in a direction indicated by arrow 368 (see FIG. 21). As wall segment 350 collapses into cavity 352, wall segment 346 rapidly pivots toward wall segment 348 in the direction indicated by arrow 366. As wall segment 346 pivots toward wall segment 348 and cavity 352 collapses, beads 342 move to occupy the space which was previously occupied by the fluid (e.g. air) within cavity 352. Since wall segment 346 and wall segment 350 are attached to interior side panel 358, interior side panel 358 is also moved toward wall segment 348 in a direction indicated by arrow 366. Wall segment 346 and interior side panel 358 continue to move in the direction indicated by arrow 366 until cavity 352 is substantially completely collapsed, and wall segment 350 is folded within cavity 352 as shown in FIG. 22. On the other hand, interior side panel 358 continues to move in the direction indicated by arrow 366 until it contacts an object positioned within passageway 334.

Figure 23:
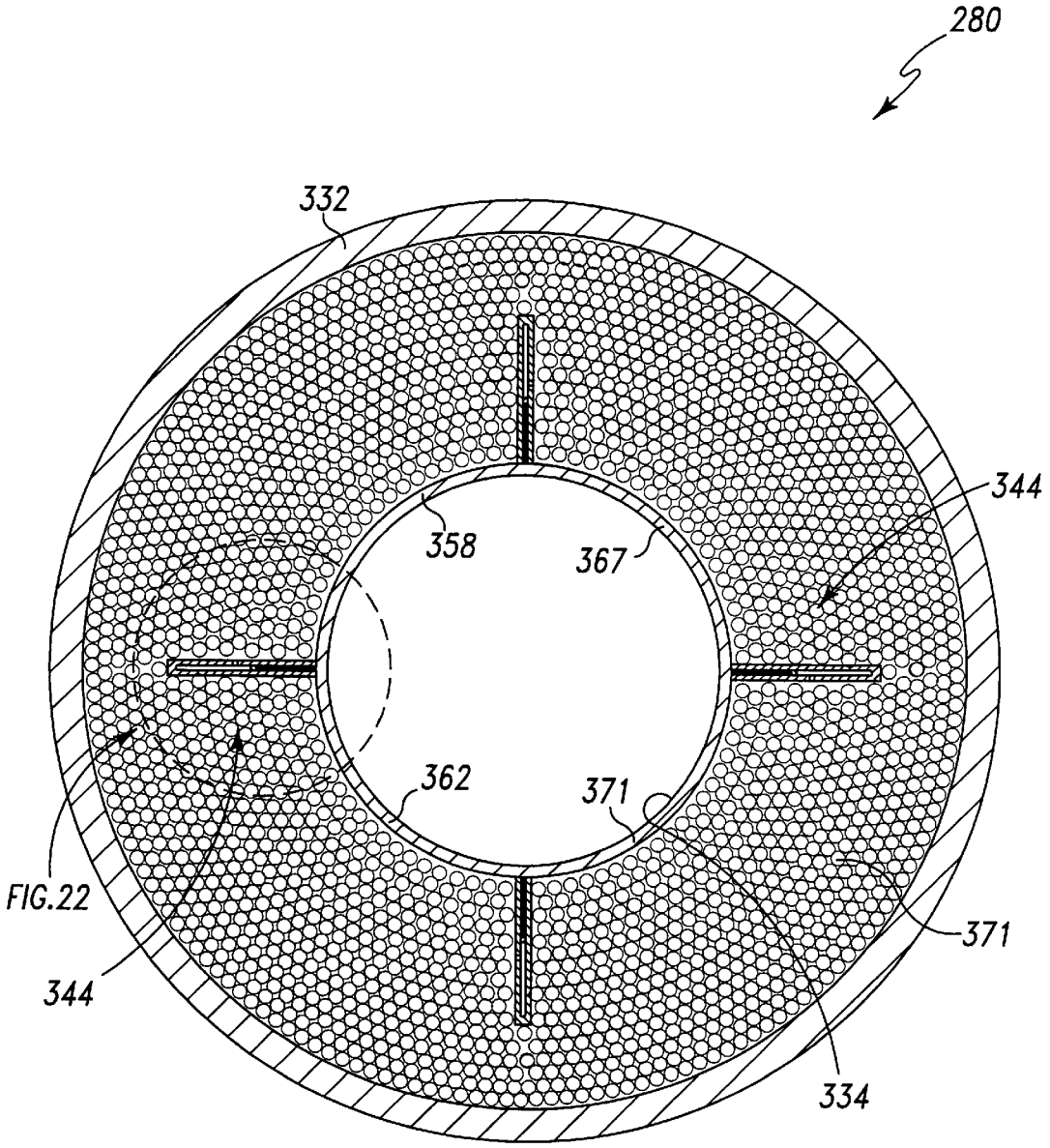
FIG. 23 is a cross sectional view of the restrainment apparatus similar to the one shown in FIG. 20, which shows the post-evacuation position of the actuators.

It should be understood that evacuating void 340, and thus collapsing cavity 352 in the above described manner, brings interior side panel 358 and adjacent interior side panel 362 into closer proximity (see FIG. 22) relative to the proximity of interior side panels 358 and 362 prior to the evacuation of void 340. It should also be appreciated that interior side panels 367 and 371 are also brought into relatively closer proximity with adjacent interior side panels as a result of collapsing cavity 352 of each actuator 344 (see FIG. 23).

Bringing interior side panels 358, 362, 367, and 371 into relative close proximity causes the diameter of passageway 334 to decrease (see FIG. 23), as compared to the diameter of passageway 334 prior to evacuation of void 340 (see FIG. 20). By evacuating void 340 and reducing the diameter of passageway 334 in the above described manner, any object positioned within passageway 334 becomes secured or immobilized therein as a result of interior side panels 358, 362, 367, and 371 "clamping down" on the object. It should be understood that having actuators 344 included in restrainment apparatus 280 is an important aspect of the present invention since actuators 344 cause interior side panels 358, 362, 367 and 371 to automatically "clamp down" on the object positioned within passageway 334 upon evacuation of void 340.

Figure 25:
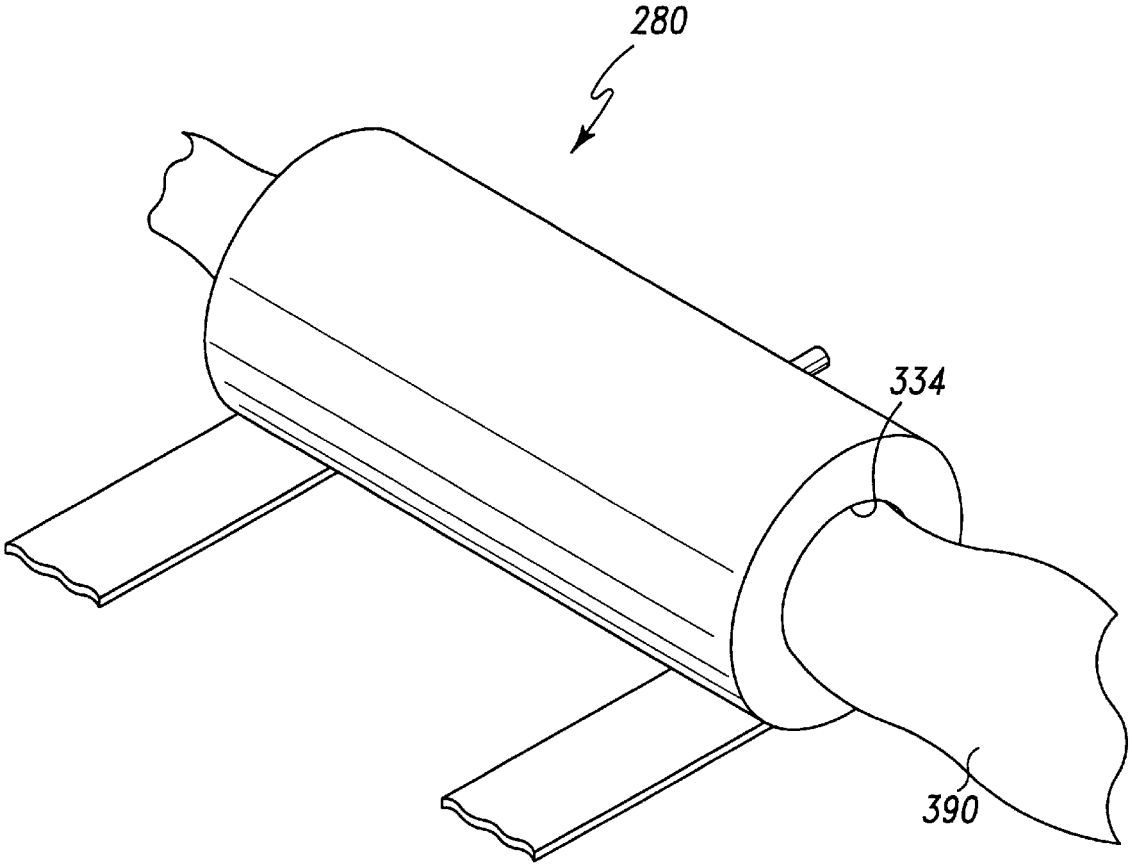
FIG. 25 is a view of the restrainment apparatus similar to the view shown in FIG. 19, but with a limb positioned within the passageway of the restrainment apparatus.

A patient (not shown) is restrained on medical table assembly 274 with restrainment apparatus 280 by positioning a limb 390 of a patient, such as an arm, within passageway 334 as shown in FIG. 25. Once limb 390 of the patient is positioned in the above described manner, void 340 is evacuated by vacuum source V. Evacuation of void 340 converts restrainment apparatus 280 from its pre-evacuation state of being a soft, pliable, bean bag-like structure, to its post-evacuation state of being a stable rigid structure and causes the diameter of passageway 334 to decrease, thereby trapping limb 390 of the patient within passageway 334 and securing the patient to medical table assembly 274.

It should be appreciated that having more than one restrainment apparatus 280 cooperating to restrain a patient on medical assembly 274 is also contemplated. It should also be appreciated that the above described rapid decrease in the diameter of passageway 334 is an important aspect of the present invention since it allows restrainment apparatus 280 to quickly and efficiently secure the patient to medical table assembly 274. Another important aspect of the present invention is that restrainment apparatus 280 will automatically adjust to different sized limbs. For example, restrainment apparatus 280 will trap a relatively large or small diameter arm positioned within passageway 334 since the diameter of passageway 334 will continue to decrease upon evacuation of void 340 until interior side panels 358, 362, 367, and 371 engage the arm.

The patient is released from medical table assembly 274 by manipulating valve 338 to allow fluid (e.g. air) to advance back into void 340 (see FIG. 20) and cavity 352 (see FIG. 21). As fluid advances back into void 340 restrainment apparatus 280 returns to the pre-evacuation state and cavity 352 of actuator 344 rapidly expands as a result of wall segment 346 moving away from wall segment 348 in a direction indicated by arrow 390 (see FIG. 22). Cavity 352 continues to expand until wall segment 350 unfolds and is positioned as shown in FIG. 21. The movement of wall segment 346 away from wall segment 348 causes interior side panel 358 to move away from interior side panel 362 in the direction indicated by arrow 390. (Note that interior side panels 367 and 371 also move away from adjacent side panels as a result of the expansion of cavity 352 in the other actuators 344 (see FIG. 20)). Movement of interior side panel 358 away from interior side panel 362 causes the diameter of passageway 334 to increase to its pre-evacuation size (see FIG. 20) which allows limb 390 (see FIG. 25) of the patient to be removed from passageway 334, thus releasing the patient from medical table assembly 274. It should be appreciated that the above described rapid increase in the diameter of passageway 334 is an important aspect of the present invention since it allows the patient to be quickly and efficiently released from medical table assembly 274.

Figure 24:
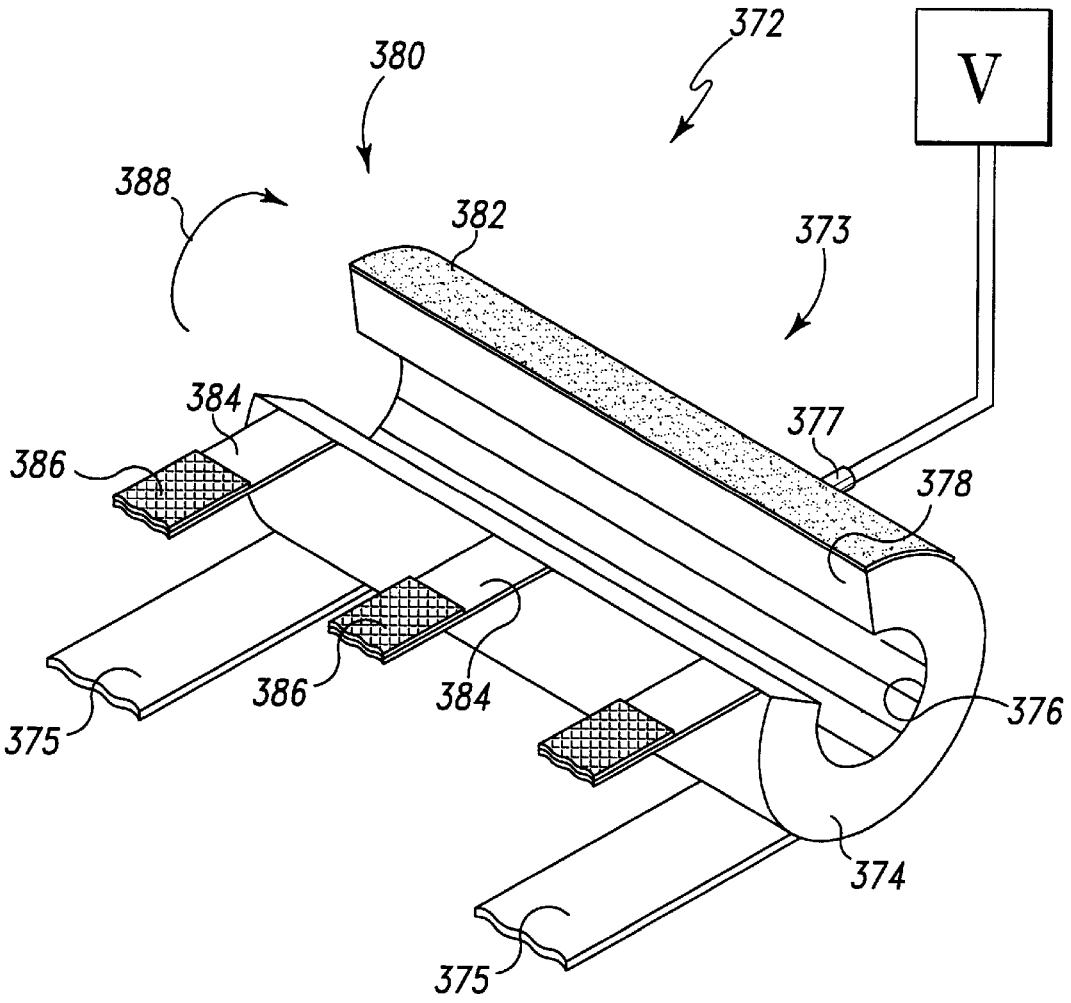
FIG. 24 is a perspective view of a restrainment apparatus similar to the one shown in FIG. 19, but with a slot defined in the bag and a hook and loop fastening mechanism attached thereto.

Referring now to FIG. 24, there is shown a restrainment apparatus 372 similar to restrainment apparatus 280. Restrainment apparatus 372 is constructed and functions in much the same way as described above in reference to restrainment apparatus 280. Specifically, restrainment apparatus 372 includes a cylindrical member 373 having a passageway 376 extending therethrough, a fluid impervious bag 374 having a void (not shown) therein, a number of actuators (not shown) identical to actuators 344, a valve 377 in fluid communication with vacuum source V, and a number of bands 375.

Restrainment apparatus 372 is mounted on medical table assembly 274 in the same way as described above in reference to restrainment apparatus 280. However, unlike restrainment apparatus 280, restrainment apparatus 372 also includes a slot 378 defined in cylindrical member 373, a number of strips 384 secured to cylindrical member 373, and a hook and loop fastening mechanism 380, such as Velcro®. Hook and loop fastening mechanism 380 includes a loop portion 382 positioned on cylindrical member 373, and a hook portion 386 positioned on each strip 384.

A patient (not shown) is restrained on medical table assembly 274 with restrainment apparatus 372 by passing a limb (e.g. an arm) of the patient through slot 378 and into passageway 376. Once the limb of the patient is positioned within passageway 376, each strip 384 is moved in a direction indicated by arrow 388 until hook portion 386 engages and attaches to loop portion 382. Fluid (e.g. air) is then evacuated from the void in bag 374, thereby causing the limb of the patient to be trapped within passageway 376 and thus securing the patient to medical table assembly 274.

The patient is released from medical table assembly 274 by (1) moving strips 384 in a direction opposite to the direction indicated by arrow 388 thus disengaging hook portion 386 from loop portion 382, (2) manipulating valve 377 to allow fluid (e.g. air) to enter into the void within bag 374, and (3) removing the patients limb from passageway 376 through slot 378.

While the invention has been illustrated and described in detail in the drawings and foregoing description, such illustration and description is to be considered as exemplary and not restrictive in character, it being understood that only the preferred embodiments have been shown and described and that all changes and modifications that come within the spirit of the invention are desired to be protected.

For example, medical table 10 or medical table 152 can include more than one prime roller. Specifically, end roller 49 of medical table 10 can be substituted with a prime roller identical to prime roller 33. In a similar fashion, the end roller of medical table 152 can be substituted with a prime roller identical to prime roller 222. These additional prime rollers can then be coupled to a motor for rotation.

Furthermore, while secondary rollers 34 are described as including a flexible fluid impervious bag 46 having a void 48 therein and a plurality of beads 50 contained within void 48, it should be understood that belt 32 can also include a flexible fluid impervious bag having a void therein and a plurality of beads contained in the void. Having belt 32 constructed in the above described manner allows belt 32 to be transformed from a soft, pliable, bean bag-like structure to a stable rigid structure. As a result, belt 32 will have many of the same advantages as discussed above in reference to secondary rollers 34.

In addition, while prime roller 33 of medical table 10 and prime roller 222 of medical table 152 are described as being coupled to, and rotated by, a motor (e.g. motor M), it should be understood that these prime rollers can also be mechanically coupled to a spring powered wind-up mechanism for rotation. Alternatively, the prime rollers can be mechanically coupled to a crank and manually rotated.

Moreover, while left segment 160 and right segment 164 of medical table 152 are described as being moved by left hydraulic cylinder 176 and right hydraulic cylinder 184, it should be understood that left segment 160 and right segment 164 can be mechanically coupled to a crank, and manually positioned at various angles relative to horizontal axis 199.

Furthermore, it should be understood that having medical table 10 or medical table 152 built in such a way that medical table 10 and 152 can accommodate X-ray fluoroscopy is contemplated.

In addition, it should be appreciated that the size and shape of restrainment apparatus 280 (including passageway 334 and actuators 344) can be altered to accommodate and secure objects having different sizes and shapes. For example, the size and shape of restrainment apparatus 280 can be altered to secure a human leg, hand or arm. Moreover, it should also be appreciated that the size and shape of restrainment apparatus 280 can be altered to secure various objects, such as freight containers, to an anchoring member such as a floor of a flatbed truck. Furthermore, it should be appreciated that restrainment apparatus 280 can be utilized as an orthopedic device for supporting and immobilizing a patient's arm relative to a patient's shoulder.

Moreover, it should be understood that a receptacle for retractably storing restrainment apparatus 278 could be mounted to bed frame 276. Specifically, the receptacle is designed such that a desired length of restrainment apparatus 278 is pulled out of the receptacle prior to use, and then retracted back into the receptacle after use. Furthermore, the receptacle could easily attach and detach from bed frame 276 and thus allow restrainment apparatus 278 to be stored apart from medical table assembly 274. Upon attachment to bed frame 276, the receptacle cooperates with vacuum source V to place restrainment apparatus 278 in fluid communication with vacuum source V.

In addition, it should be understood that restrainment apparatus 280 can be attached to a storage box. The storage box is designed to easily attach and detach from bed frame 276 and thus allows restrainment apparatus 280 to be stored apart from medical table assembly 274. Upon attachment to bed frame 276, the storage box cooperates with vacuum source V to place restrainment apparatus 280 in fluid communication with vacuum source V.

What is claimed is:

1. A medical table assembly, comprising:

a bed frame;

a restrainment apparatus mounted to said bed frame, wherein said restrainment apparatus (1) defines a fluid impervious bag having a void therein, and (2) contains a plurality of beads within said void of said fluid impervious bag; and a vacuum source in fluid communication with said void of said restrainment apparatus.

2. The assembly of claim 1, wherein movement of said plurality of beads contained in said void of said restrainment apparatus is inhibited when fluid is evacuated from said void.

3. The assembly of claim 1, further comprising a mattress supported by said bed frame, wherein:

said restrainment apparatus includes a strap, said strap includes said fluid impervious bag, and said strap is attached to said bed frame so that said fluid impervious bag is positioned over said mattress.

4. The assembly of claim 3, wherein:

said mattress has a first lateral side and a second lateral side, said strap has a first end and a second end, said first end of said strap is secured to said bed frame at a first position located adjacent to said first lateral side of said mattress, and said second end of said strap is secured to said bed frame at a second position located adjacent to said second lateral side of said mattress.

5. The assembly of claim 4, wherein:

a buckle is attached to said bed frame at said second position located adjacent to said second lateral side of said mattress, said strap further includes a connecting member which attaches said first end of said strap to said bed frame at said first position located adjacent to said first lateral side of said mattress, and said strap further includes a tab which cooperates with said buckle so as to secure said second end of said strap to said bed frame at said second position located adjacent to said second lateral side of said mattress.

6. The assembly of claim 1, wherein:

said restrainment apparatus has a passageway extending therethrough for receiving a body part of a patient positioned on said mattress.

7. The assembly of claim 6, wherein:

said restrainment apparatus includes an actuator, said actuator includes a first wall segment, a second wall segment, and a third wall segment which collectively define a cavity, said first wall segment is pivotally attached to said second wall segment, said third wall segment is attached to both said first wall segment and said second wall segment, said cavity is in fluid communication with said vacuum source, and said first wall segment pivots toward said second wall segment when fluid is evacuated from said cavity.

8. The assembly of claim 7, wherein said third wall segment defines a first portion of said passageway.

9. The assembly of claim 8, wherein:

said restrainment apparatus includes a first interior side panel which defines a second portion of said passageway, said restrainment apparatus includes a second interior side panel which defines a third portion of said passageway, and said first interior side panel moves toward said second interior side panel during evacuation of fluid from said cavity.

10. The assembly of claim 9, wherein said first interior side panel moves away from said second interior side panel during advancement of fluid into said cavity.

11. The assembly of claim 9, wherein said first interior side panel, said second interior side panel, and said third wall segment define a continuous inner surface segment of said passageway.

12. A medical table assembly, comprising:

a bed frame;

a mattress supported by said bed frame;

a restrainment apparatus mounted to said bed frame, wherein said restrainment apparatus includes (1) a strap which (a) defines a fluid impervious bag having a void therein, and (b) is attached to said bed frame so that said fluid impervious bag is positioned over said mattress, and (2) a plurality of beads contained within said void of said fluid impervious bag; and a vacuum source in fluid communication with said void of said restrainment apparatus.

13. The assembly of claim 12, wherein:

said mattress has a first lateral side and a second lateral side, said strap has a first end and a second end, said first end of said strap is secured to said bed frame at a first position located adjacent to said first lateral side of said mattress, and said second end of said strap is secured to said bed frame at a second position located adjacent to said second lateral side of said mattress.

14. The assembly of claim 13, wherein:

a buckle is attached to said bed frame at said second position located adjacent to said second lateral side of said mattress, said strap further includes a connecting member which attaches said first end of said strap to said bed frame at said first position located adjacent to said first lateral side of said mattress, and said strap further includes a tab which cooperates with said buckle so as to secure said second end of said strap to said bed frame at said second position located adjacent to said second lateral side of said mattress.

15. A medical table assembly, comprising:

a bed frame;

a mattress supported by said bed frame, a first restrainment apparatus mounted to said bed frame, wherein said first restrainment apparatus (1) defines a fluid impervious bag having a void therein, (2) contains a plurality of beads within said void of said fluid impervious bag, and (3) has a passageway extending therethrough for receiving a first body part of a patient positioned on said mattress; and a vacuum source in fluid communication with said void of said first restrainment apparatus.

16. The assembly of claim 15, further comprising:

a second restrainment apparatus mounted to said bed frame, wherein said second restrainment apparatus (1) defines a fluid impervious bag having a void therein, (2) contains a plurality of beads within said void of said fluid impervious bag, and (3) has a passageway extending therethrough for receiving a second body part of a patient positioned on said mattress, wherein said mattress has a first lateral side and a second lateral side, said first restrainment apparatus is secured to said bed frame at a first position located adjacent to said first lateral side of said mattress, said second restrainment apparatus is secured to said bed frame at a second position located adjacent to said second lateral side of said mattress, and said vacuum source is in fluid communication with said void of said second restrainment apparatus.

17. The assembly of claim 16, wherein:

said first restrainment apparatus and said second restrainment apparatus each include an actuator, said actuator includes a first wall segment, a second wall segment, and a third wall segment which collectively define a cavity, said first wall segment is pivotally attached to said second wall segment, said third wall segment is attached to both said first wall segment and said second wall segment, said cavity is in fluid communication with said vacuum source, and said first wall segment pivots toward said second wall segment when fluid is evacuated from said cavity.

18. A securement assembly, comprising:

an anchoring member;

a restrainment apparatus attached to said anchoring member, wherein said restrainment apparatus (1) defines a fluid impervious bag having a void therein, and (2) contains a plurality of beads within said void of said fluid impervious bag; and a vacuum source in fluid communication with said void of said restrainment apparatus.

19. The securement assembly of claim 18, wherein:

said restrainment apparatus has a passageway extending therethrough for receiving an object.

20. The securement assembly of claim 19, wherein:

said restrainment apparatus includes an actuator, said actuator includes a first wall segment, a second wall segment, and a third wall segment which collectively define a cavity, said first wall segment is pivotally attached to said second wall segment, said third wall segment is attached to both said first wall segment and said second wall segment, said cavity is in fluid communication with said vacuum source, and said first wall segment pivots toward said second wall segment when fluid is evacuated from said cavity.

21. The securement assembly of claim 20, wherein:

said anchoring member is a bed frame to which said restrainment apparatus is attached.

22. A method of immobilizing an object, comprising the steps of:

providing a restrainment apparatus, wherein said restrainment apparatus (1) includes a fluid impervious bag having a void therein, (2) contains a plurality of beads within said void of said fluid impervious bag, (3) has a first interior side panel which defines a first portion of a passageway defined in said restrainment apparatus, and (4) includes an actuator coupled to said first interior side panel;

positioning said object within said passageway;

providing a vacuum source in fluid communication with said void; and creating a vacuum within said void with said vacuum source such that said actuator causes said first interior side panel to move toward said object.

23. The method of claim 22, wherein:

said restrainment apparatus includes a second interior side panel which defines a second portion of said passageway, said actuator is coupled to said second interior side panel, and said actuator causes said second interior side panel to move toward said object during said creation of said vacuum.

24. The method of claim 23, wherein:

said actuator includes a first wall segment, a second wall segment, and a third wall segment which collectively define a cavity, said first wall segment is pivotally attached to said second wall segment, said third wall segment is attached to both said first wall segment and said second wall segment, said cavity is in fluid communication with said vacuum source, and said first wall segment pivots toward said second wall segment when a vacuum is created within said void with said vacuum source.

25. The method of claim 24, wherein:

said third wall segment defines a third portion of said passageway defined in said restrainment apparatus.

26. The method of claim 25, wherein:

said first interior side panel, said second interior side panel, and said third wall segment define a continuous inner surface segment of said passageway.

27. The method of claim 24, wherein:

said first wall segment is attached to said first interior side panel, and said second wall segment is attached to said second interior side panel.

28. The method of claim 27, wherein:

said first interior side panel moves away from said second interior side panel during advancement of fluid into said cavity.

* * * * *